US008220907B2

(12) United States Patent
Steiner et al.

(10) Patent No.: US 8,220,907 B2
(45) Date of Patent: Jul. 17, 2012

(54) NON-CONDUCTIVE FLUID DROPLET CHARACTERIZING APPARATUS AND METHOD

(75) Inventors: Thomas W. Steiner, Burnaby (CA); Fernando Luis de Souza Lopes, Richmond (CA)

(73) Assignee: Kodak Graphic Communications Canada Company, Burnaby (CA)

( * ) Notice: Subject to any disclaimer, the term of this patent is extended or adjusted under 35 U.S.C. 154(b) by 279 days.

(21) Appl. No.: 12/582,794

(22) Filed: Oct. 21, 2009

(65) Prior Publication Data

US 2010/0039465 A1 Feb. 18, 2010

Related U.S. Application Data

(62) Division of application No. 11/240,826, filed on Sep. 30, 2005, now Pat. No. 7,641,325.

(60) Provisional application No. 60/615,765, filed on Oct. 4, 2004.

(51) Int. Cl.
*B41J 2/085* (2006.01)
*B41J 2/02* (2006.01)

(52) U.S. Cl. ..... 347/76; 347/73

(58) Field of Classification Search ..... 347/73–79
See application file for complete search history.

(56) References Cited

U.S. PATENT DOCUMENTS

| | | | |
|---|---|---|---|
| 3,373,437 | A | 3/1968 | Sweet et al. |
| 3,596,275 | A | 7/1971 | Sweet |
| 3,893,623 | A | 7/1975 | Toupin |
| 3,949,410 | A | 4/1976 | Bassous et al. |
| 4,123,760 | A | 10/1978 | Hou |
| 4,190,844 | A | 2/1980 | Taylor |
| 4,408,211 | A | 10/1983 | Yamada |
| 1,941,001 | A | 12/1993 | Hansell |
| 5,583,552 | A | 12/1996 | Mutoh |
| 6,079,821 | A | 6/2000 | Chwalek et al. |
| 6,154,226 | A | 11/2000 | York et al. |
| 6,158,844 | A | 12/2000 | Murakami et al. |
| 6,312,110 | B1 | 11/2001 | Darty |
| 6,554,410 | B2 | 4/2003 | Jeanmaire et al. |
| 2003/0001925 | A1 | 1/2003 | Ogawa et al. |
| 2004/0165050 | A1 * | 8/2004 | Horie et al. ..... 347/100 |

FOREIGN PATENT DOCUMENTS

EP 1 219 428 7/2002

* cited by examiner

*Primary Examiner* — Geoffrey Mruk
(74) *Attorney, Agent, or Firm* — William R. Zimmerli

(57) ABSTRACT

A fluid droplet characterizing apparatus and method includes a pressurized source of a non-conductive fluid in fluid communication with a nozzle channel and a characterization electrode. The pressurized source is operable to form a jet of the non-conductive fluid through the nozzle channel. At least one portion of the characterization electrode is electrically conductive and contactable with first portion and thereafter a second portion of the non-conductive fluid jet. The at least one electrically conductive portion of the characterization electrode is operable to transfer a first electrical charge to a region of the first portion of the non-conductive fluid jet and transfer a second electrical charge to a region of the second portion of the non-conductive fluid jet.

12 Claims, 11 Drawing Sheets

NON-CONDUCTIVE FLUID DROPLET CHARACTERIZING APPARATUS AND METHOD

CROSS REFERENCE TO RELATED APPLICATIONS

This is a Divisional Application of U.S. application Ser. No. 11/240,826, filed Sep. 30, 2005, U.S. Pat. No. 7,641,325 B2 which claims priority from Provisional Application Ser. No. 60/615,765 filed Oct. 4, 2004.

This application is related to U.S. Pat. No. 7,658,479 entitled Non-conductive Fluid Droplet Forming Apparatus and Method, filed Sep. 27, 2005.

FIELD OF THE INVENTION

This invention relates generally to the field of digitally controlled fluid drop forming devices, and in particular to devices that form drops with non-conductive fluids.

BACKGROUND OF THE INVENTION

The use of ink jet printers for printing information on a recording media is well established. Printers employed for this purpose may be grouped into those that continuously emit a stream of fluid droplets, and those that emit droplets only when corresponding information is to be printed. The former group is generally known as continuous inkjet printers and the latter as drop-on-demand inkjet printers. The general principles of operation of both of these groups of printers are very well recorded. Drop-on-demand inkjet printers have become the predominant type of printer for use in home computing systems, whereas continuous inkjet systems find major application in industrial and professional environments. Typically, continuous inkjet systems produce higher quality images at higher speeds than drop-on-demand systems.

Continuous inkjet systems typically have a print head that incorporates a fluid supply system for fluid and a nozzle plate with one or more nozzles fed by the fluid supply. The fluid is jetted through the nozzle plate to form one or more thread-like streams of fluid from which corresponding streams of droplets are formed. Within each of the streams of droplets, some droplets are selected to be printed on a recording surface, while other droplets are selected not to be printed, and are consequently guttered. A gutter assembly is typically positioned downstream from the nozzle plate in the flight path of the droplets to be guttered.

In order to create the stream of droplets, a droplet generator is associated with the print head. The droplet generator stimulates the stream of fluid within and just beyond the print head, by a variety of mechanisms known in the art, at a frequency that forces continuous streams of fluid to be broken up into a series of droplets at a specific break-off point within the vicinity of the nozzle plate. In the simplest case, this stimulation is carried out at a fixed frequency that is calculated to be optimal for the particular fluid, and which matches a characteristic drop spacing of the fluid jet ejected from the nozzle orifice. The distance between successively formed droplets, S, is related to the jet velocity, v, and the stimulation frequency, f, by the relationship: $v=f S$. U.S. Pat. No. 3,596,275, issued to Sweet, discloses three types of fixed frequency generation of droplets with a constant velocity and mass for a continuous inkjet recorder. The first technique involves vibrating the nozzle itself. The second technique imposes a pressure variation on the fluid in the nozzle by means of a piezoelectric transducer placed typically within the cavity feeding the nozzle. A third technique involves exciting a fluid jet electrohydrodynamically (EHD) with an EHD droplet stimulation electrode.

Additionally, continuous inkjet systems employed in high quality printing operations typically require small closely spaced nozzles with highly uniform manufacturing tolerances. Fluid forced under pressure through these nozzles typically causes the ejection of small droplets, on the order of a few pico-liters in size, traveling at speeds from 10 to 50 meters per second. These droplets are generated at a rate ranging from tens to many hundreds of kilohertz. Small, closely spaced nozzles, with highly consistent geometry and placement can be constructed using micro-machining technologies such as those found in the semiconductor industry. Typically, nozzle channel plates produced by these techniques are typically made from materials such as silicon and other materials commonly employed in micromachining manufacture (MEMS). Multi-layer combinations of materials can be employed with different functional properties including electrical conductivity. Micro-machining technologies may include etching. Therefore through-holes can be etched in the nozzle plate substrate to produce the nozzles. These etching techniques may include wet chemical, inert plasma or chemically reactive plasma etching processes. The micro-machining methods employed to produce the nozzle channel plates may also be used to produce other structures in the print head. These other structures may include ink feed channels and ink reservoirs. Thus, an array of nozzle channels may be formed by etching through the surface of a substrate into a large recess or reservoir which itself is formed by etching from the other side of the substrate.

FIG. 1 schematically illustrates a prior art conventional electrohydrodynamic (EHD) stimulation means used to excite a jet of conductive fluid into a stream of droplets. Fluid supply 10 contains conductive fluid 12 under pressure which forces ink through nozzle channel 20 in the form of a conductive fluid jet 22. Conductive fluid 12 is grounded or otherwise connected through an electrical pathway. A prior art droplet stimulation electrode 15 is approximately concentric with an exit orifice 21 of nozzle channel 20 as shown in cross-section in FIG. 1A. Droplet stimulation electrode 15 typically includes a conductive electrode structure 13 produced from a variety of conductive materials, including a surface metallization layer, or from one or more layers of a semiconductor substrate doped to achieve certain conductivity levels. Prior art conductive electrode structure 13 is electrically connected to a stimulation signal driver 17 that produces a potential waveform of chosen voltage amplitude, period and functional relationship with respect to time in accordance to a stimulation signal 19. In FIG. 1, an example of a stimulation signal 19 comprises a uni-polar square wave with a 50% duty cycle. The resulting EHD stimulation is a function of the square of field strength created at the surface of the conductive fluid 12 near exit orifice 21. The resulting EHD stimulation induces charge in the conductive fluid jet 22 and creates pressure variations along the jet. Conductive electrode structure 13 is covered by one or more insulating layers 24 which are necessary to isolate droplet stimulation electrode 15 from conductive fluid 12 in order to prevent field collapse, excessive current draw and/or resistive heating of conductive fluid 12. The conductive fluid 12 must be sufficiently conductive to allow charge to move through the fluid from the grounded fluid supply 10 in order to electrohydrodynamically stimulate conductive fluid jet 22 to form droplets that subsequently form at break-off point 26. Since conductive fluids are employed, a non-uniform distribution of charge cannot be supported in the fluid jet column outside of the stimulating electric field. The electrohydrodynamic stimulation effect occurs due to the momentary induction of charge in conductive fluid 12 at nozzle orifice 20 that creates the pressure variation in fluid jet 22. For a correctly chosen frequency of the stimulation signal 19, the perturbation arising from the pressure variations will grow on the conductive fluid jet 22 until break-off occurs at the break-off point 26.

Various means for distinguishing or characterizing printing droplets from non-printing droplets in the continuous stream of droplets have been described in the art. One commonly used practice is that of electrostatic charging and electrostatic deflecting of selected droplets as described in U.S. Pat. No. 1,941,001, issued to Hansell, and U.S. Pat. No. 3,373,437, issued to Sweet et al. In these patents, a charge electrode is positioned adjacent to the break-off point of fluid jet. Charge voltages are applied to this electrode thus generating an electric field in the region where droplets separate from the fluid. The function of the charge electrode is to selectively charge the droplets as they break off from the fluid jet.

Referring back to FIG. 1, a typical prior art electrostatic droplet characterizing means includes charging electrode 30. Conductive fluid 12 is employed such that a current return path exists through the fluid supply 10 (e.g. through grounding). A charge is induced in a specific droplet under the influence of the field generated by charge electrode 30. This droplet charge is locked in on the droplet when it separates from the fluid jet 22. Charging electrode 30 is electrically connected to charge electrode driver 32. The charging electrode 30 is driven by a time varying voltage. The voltage attracts charge through conductive fluid 12 to the end of the fluid stream where it becomes locked-in or captured on charged droplets 34 once they break-off from the jet 22.

A high level of conductivity of fluid 12 is required to effectively charge droplets formed in these prior art systems. Prior art inkjet print heads that employ electrostatic droplet characterizing means typically use conductive fluid 12 conductivities on the order of 5 mS/cm. These conductivity levels permit induction of sufficient charge on charged droplets 34 to allow downstream electrostatic deflection. The conductivity required for droplet charging is typically much greater than that for droplet stimulation. Typically, a conductive fluid suitable for charging can also be stimulated using EHD principles. The selective charging of the droplets in conventional electrostatic prior art inkjet systems allows each droplet to be characterized. That is, the conductive inks permit charges of varying levels and polarities to be selectively induced on the droplets such that they can be characterized for different purposes. Such purposes may include selectively characterizing each of the droplets to be used for printing or to not be used for printing.

Again referring to the prior art system shown in FIG. 1, a potential waveform produced by the charging electrode driver 32 will determine how the formed droplets will be characterized. The potential waveform will determine which of the formed droplets will be selected for printing and which of the formed droplets will not be selected for printing. Droplets in this example are characterized by charging as shown by charged droplets 34 and uncharged droplets 36. Since a specific droplet characterization is dependant upon whether that droplet is printed with or not, the potential waveform will typically be based at least in part on a print-data stream provided by one or more systems controllers (not shown). The print-data stream typically comprises instructions as to which of the specific droplets within the stream of droplets are to be printed with, or not printed with. The potential waveform will therefore vary in accordance with the image content of the specific image to be reproduced.

Additionally, the potential waveform may also be based on methods or schemes employed to improve various printing quality aspects such as the placement accuracy of droplets selected for printing. Guard drop schemes are an example of these methods. Guard drop schemes typically define a regular repeating pattern of specific droplets within the continuous stream of droplets. These specific droplets, which may be selected to print with if required by the print-data stream, are referred to as "print-selectable" droplets. The pattern is additionally arranged such that additional droplets separate the print-selectable droplets. These additional droplets cannot be printed with regardless of the print-data stream and are referred to as "non-print selectable" droplets. This is done so as to minimize unwanted electrostatic field effects between the successive print-selectable droplets. Guard drop schemes may be programmed into one or more systems controllers (not shown) and will therefore alter the potential waveform so as to define the print-selectable droplets. The voltage waveform will therefore characterize printing droplets from non-printing droplets by selectively charging individual droplets within the stream of droplets in accordance with the print data stream and any guard drop scheme that is employed.

Again referring to the prior art system shown in FIG. 1, electrostatic deflection plates 38 placed near the trajectory of the characterized droplets interact with charged droplets 34 by steering them according to their charge and the electric field between the plates. In this example, charged droplets 34 that are deflected by deflection plates 38 are collected on a gutter 40 while uncharged droplets 36 pass through substantially un-deflected and are deposited on a receiver surface 42. In other systems, this situation may be reversed with the deflected charged droplets being deposited on the receiver surface 42. In either case, further complications arise from the fact that the charging electrode driver 32 must be synchronized with stimulation signal driver 17 to ensure that optimum charge levels are transferred to droplets, thus ensuring accurate droplet printing or guttering as the architecture of the recorder may dictate. These synchronization constraints arise as result of charging or characterizing those conductive fluid droplets at a place and time separate from their stimulation. Although prior art electrostatic characterization and deflection systems are advantageous in that they permit large droplet deflection, they have the disadvantage that they have been used primarily only with conductive fluids, thus limiting the applications of these systems.

A wide range of fluid properties is desirable in commercial inkjet applications. Jetted inks may be made with pigments or dyes suspended or dissolved in fluid mediums comprised of oils, solvents, polymers or water. These fluids typically have a large range of physical properties including viscosity, surface tension and conductivity. Some of these fluids are considered to be non-conductive fluids, and thus have insufficient levels of conductivity so as to be employed in continuous inkjet systems that rely on the selective electrostatic charging and deflection of conductive fluid droplets.

Various systems and methods for stimulating a non-conductive fluid medium to form a series of droplets and for characterizing the series of droplets to form "printing" droplets and "non-printing" droplets have been proposed. For example, U.S. Pat. No. 3,949,410, issued to Bassous et al., teaches use of a monolithic structure useful for the EHD stimulation of conductive fluid droplets in a jet stream emitted from a nozzle.

U.S. Pat. No. 6,312,110, issued to Darty, and U.S. Pat. No. 6,154,226, issued to York et al., teach the construction of various inkjet print heads wherein droplets are not stimulated from a stream of non-conductive fluid. Rather, the print heads comprises EHD pumps within the print head nozzles themselves. Droplets are ejected from the fluid supply in a similar fashion to drop-on-demand printers.

U.S. Pat. No. 4,190,844, issued to Taylor, teaches a use of a first pneumatic deflector for deflecting non-printing ink droplets towards a droplet catcher. A second pneumatic deflector either creates an "on-off" basis for line-at-a-time printing, or a continuous basis for character-by-character printing.

U.S. Pat. No. 6,079,821, issued to Chwalek et al., teaches a use of asymmetric heaters to both create and deflect individual droplets formed in a continuous inkjet recorder. Deflection of the droplets occurs by the asymmetrical heating of the jetted stream.

U.S. Pat. No. 4,123,760, issued to Hou, teaches the use of deflection electrodes upstream of a break-off point from which droplets are formed from a corresponding jetted fluid stream. Droplets produced by the stream are steered to different laterally separated printing locations by applying a cyclic differential charging signal to the deflection electrodes. This causes a deflection of the unbroken fluid stream which directs the droplets towards their desired printing positions.

It can be seen that there is a need to provide an apparatus and method of characterizing a non-conductive fluid droplet or droplets formed from a jet of non-conductive fluid.

SUMMARY OF THE INVENTION

According to a feature of the present invention, an apparatus for characterizing fluid droplets formed from a non-conductive fluid jet includes a nozzle channel, a pressurized source of a non-conductive fluid in fluid communication with the nozzle channel, and a characterization electrode. The pressurized source is operable to form a jet of the non-conductive fluid through the nozzle channel. At least one portion of the characterization electrode is electrically conductive and contactable with a first portion of the non-conductive fluid jet and thereafter contactable with a second portion of the non-conductive fluid jet. The at least one electrically conductive portion of the characterization electrode is operable to transfer a first electrical charge to a region of the first portion of the non-conductive fluid jet and transfer a second electrical charge to a region of the second portion of the non-conductive fluid jet. A first fluid droplet formed from a first portion of the non-conductive fluid jet has a first characteristic and a second fluid droplet formed from a second portion of the non-conductive fluid jet has a second characteristic.

According to another feature of the present invention, a method of characterizing fluid droplets includes providing a non-conductive fluid jet; providing a first electrical charge on an electrically conductive portion of a characterization electrode; characterizing a first fluid droplet formed from a first portion of the non-conductive fluid jet by transferring the first electrical charge from the electrically conductive portion of the characterization electrode to the first portion of the non-conductive fluid jet; providing a second electrical charge on the electrically conductive portion of the characterization electrode; and characterizing a second fluid droplet formed from a second portion of the non-conductive fluid jet by transferring the second electrical charge from the electrically conductive portion of the characterization electrode to the second portion of the non-conductive fluid jet.

According to another feature of the present invention, an electrode for characterizing fluid droplets formed from a non-conductive fluid jet includes at least one electrically conductive portion contactable with a first portion of the non-conductive fluid jet and thereafter contactable with a second portion of the non-conductive fluid jet. The at least one electrically conductive portion is operable to transfer a first electrical charge to a first portion of the non-conductive fluid jet and transfer a second electrical charge to a second portion of the non-conductive fluid jet.

According to another feature of the present invention, an apparatus for characterizing a fluid droplet formed from a non-conductive fluid jet includes a nozzle channel, a pressurized source of a non-conductive fluid in fluid communication with the nozzle channel, and an electrode. The pressurized source is operable to provide a jet of the non-conductive fluid through the nozzle channel. At least one portion of the electrode is electrically conductive and contactable with the non-conductive fluid jet. The at least one electrically conductive portion of the electrode is operable to transfer an electrical charge to a portion of the non-conductive fluid jet. A fluid droplet formed from the non-conductive fluid jet has a characteristic.

According to another feature of the present invention, a method of characterizing a fluid droplet includes providing a non-conductive fluid jet; providing an electrical charge on an electrically conductive portion of an electrode; and characterizing a fluid droplet formed from the non-conductive fluid jet by transferring the electrical charge from the electrically conductive portion of the electrode to a portion of the non-conductive fluid jet, wherein transferring the electrical charge from the electrically conductive portion of the electrode includes contacting the non-conductive fluid jet with the electrically conductive portion of the electrode.

According to another feature of the present invention, a stream of droplets is formed from a corresponding jet of non-conductive fluid. Each of the droplets is characterized for a specific purpose. Such a purpose may include characterizing a specific droplet such that it may be subsequently used for printing. Alternatively, a droplet may be characterized such that it is subsequently disposed in a guttering means Each droplet that is selected for a given purpose is characterized so that it is distinguished from other droplets that have been characterized for another purpose.

A droplet characterizing electrode is used to characterize each of the droplets in the stream of non-conductive fluid droplets. The droplet characterizing electrode transfers charge to one or more regions of the non-conductive fluid jet. The jet is stimulated such that a specific droplet is formed from the corresponding regions of the jet. The specific droplet may be characterized at least in part, by the charge that has been transferred to the corresponding region or regions from which it was formed.

One or more systems controllers are used create and provide a droplet characterization signal. The droplet characterization signal comprises a signal waveform that is structured in accordance a print data stream that provides information defining a selected sequence of printing and non-printing droplets required to successfully record a desired image. The droplet characterization signal waveform may also be structured in accordance with a guard drop scheme.

The droplet characterization signal is provided to an electrical driver known as a droplet characterization driver that in turn provides a potential waveform to the droplet characterization electrode to selectively transfer charge the various regions of the jet. The droplet characterization electrode may transfer different characterizing charges to the different regions of the jet in accordance with the characterizing information of the droplet characterizing signal. Different characterizing charges may be of different magnitudes or polarities. The characterizing charges may be applied in accordance with the intended purpose that a specific droplet that will subsequently comprise at least a portion of these charges.

Although the droplet characterization electrode is capable of selectively characterizing droplets by a transfer of charge, it is additionally capable of also forming droplets from this transfer of charge. The transfer of charge may be used stimulate the non-conductive jet to form the droplets. The droplet characterization signal may include various waveforms that will lead to the formation of a stream of droplets made up of differently sized droplets. Any given droplet in the stream of droplets may be characterized by being selectively formed with a specific size or volume representative of a desired characterization chosen for that droplet.

In addition to the exemplary features and embodiments described above, further features and embodiments will become apparent by reference to the drawings and the detailed description.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus and method in accordance with the present invention. It is to be understood that elements not specifically shown or described may take various forms well known to those skilled in the art.

Figure 1:
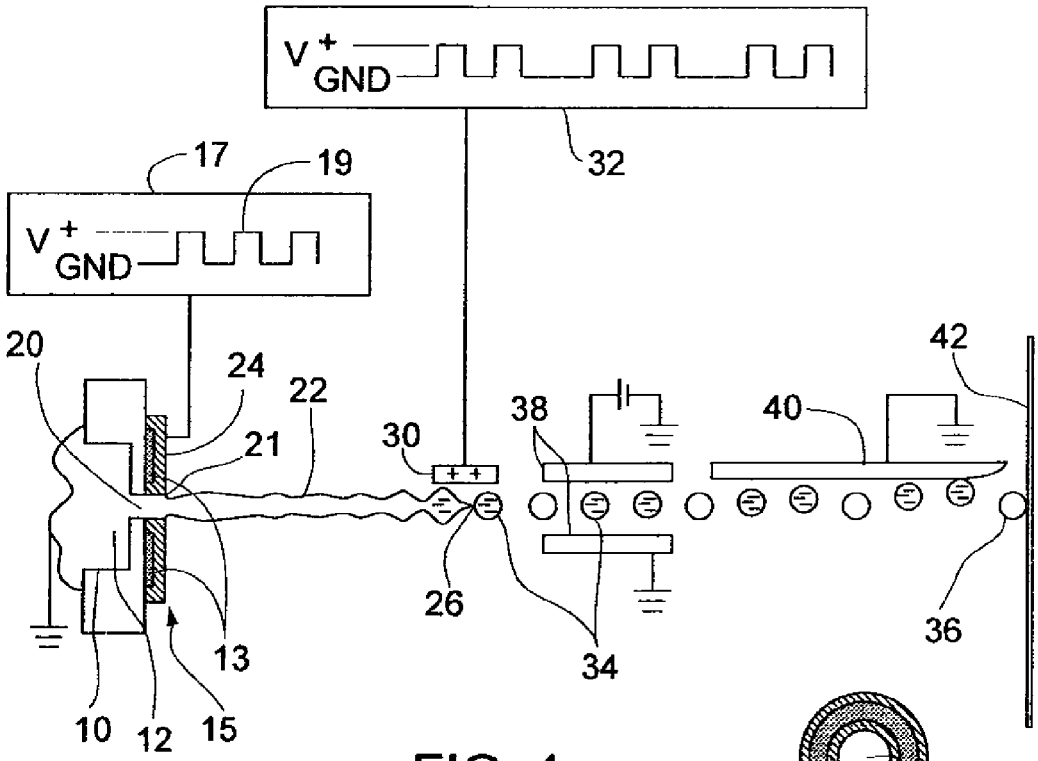
FIG. 1 PRIOR ART
FIG. 1 is a schematic representation of a prior art inkjet recording apparatus that employs electrostatic charging and deflection means.
Figure 1A:
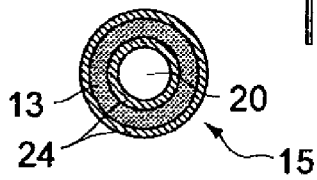
FIG. 1A PRIOR ART
FIG. 1A is a cross-section view of prior art droplet stimulation electrode shown in FIG. 1.
Figure 2:
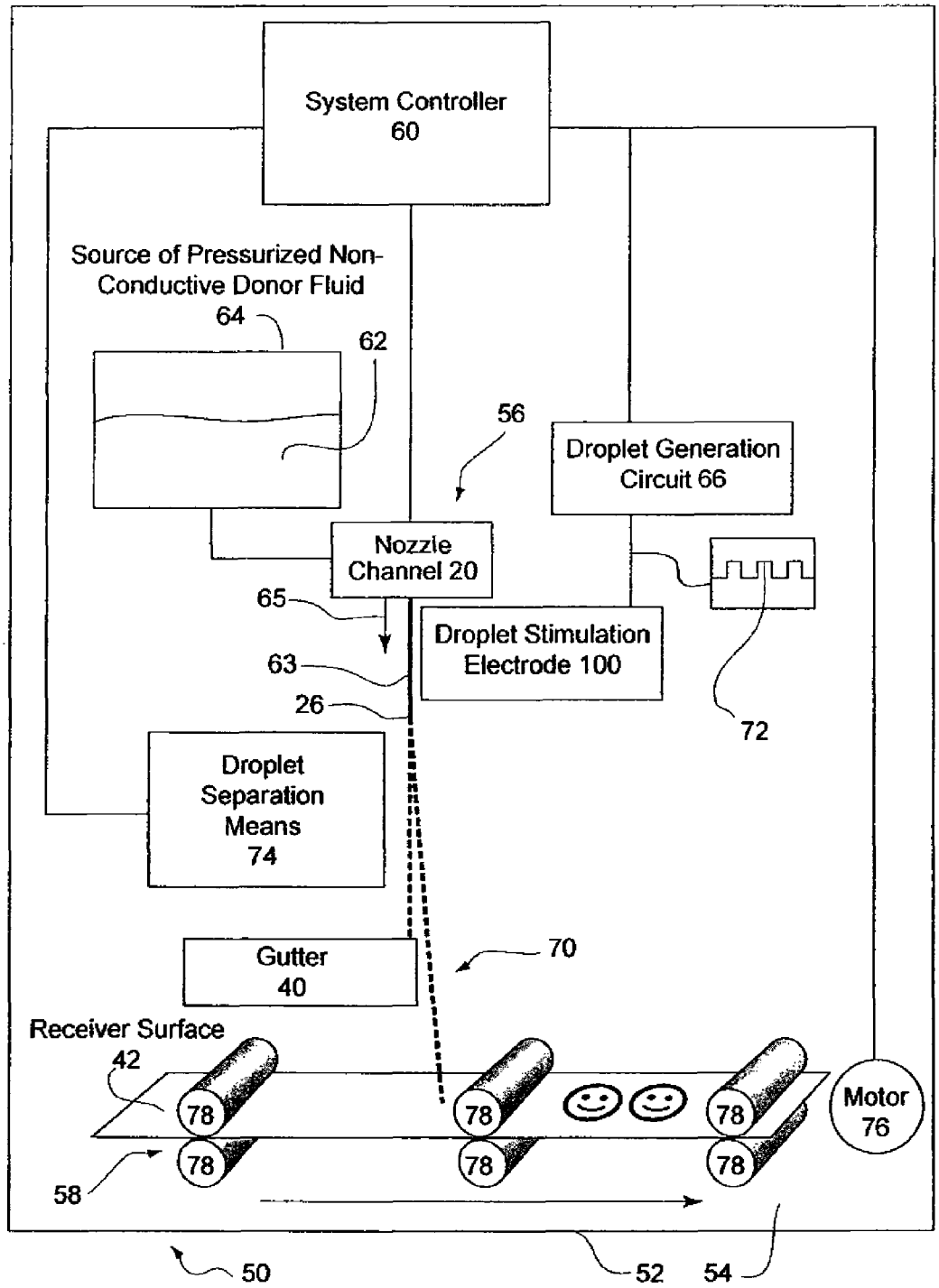
FIG. 2 is an embodiment of a printing apparatus.

FIG. 2 schematically shows a printing apparatus 50 including an example embodiment of the present invention. Printing apparatus 50 includes a housing 52 that can comprise any of a box, closed frame, continuous surface or any other enclosure defining an interior chamber 54. In the embodiment of FIG. 2, interior chamber 54 of housing 52 holds an inkjet print-head 56, a translation unit 58 that positions a receiver surface 42 relative to inkjet print-head 56, and systems controller 60. System controller 60 may comprise a micro-computer, micro-processor, micro-controller or any other known arrangement of electrical, electro-mechanical and electro-optical circuits and systems that can reliably transmit signals to inkjet print-head 56 and translation unit 58 to allow the pattern-wise disposition of non-conductive donor fluid 62 onto receiver surface 42. Systems controller 60 may comprise a single controller or it may comprise a plurality of controllers.

As shown in FIG. 2, inkjet print-head 56 includes a source of pressurized non-conductive donor fluid 64 such as a pressurized reservoir or a pump arrangement and a nozzle channel 20 allowing the pressurized non-conductive donor fluid 62 to form a non-conductive fluid jet 63 traveling in a first direction 65 toward receiver surface 42. A droplet generation circuit 66 is in electrical communication with a droplet stimulation (or formation) electrode 100. In response to a droplet stimulation (or formation) signal 72, droplet stimulation electrode 100 applies a force to non-conductive fluid jet 63 to perturb fluid jet 63 to form a stream of droplets 70 at a break-off point 26. Discrete or integrated components within the droplet generation circuit 66 such as timing circuits of a type well known to those of skill in the art may be used or adapted for use in generating the droplet stimulation signal 72 to form droplets.

Selected droplets within the stream of droplets 70 may be characterized to be printed with or not to be printed as described in embodiments of the present invention to follow. Printing apparatus 50 may employ methods and apparatus as taught in embodiments of the present invention to characterize selected droplets within the stream of droplets 70. Embodiments of the present invention may use droplet stimulation electrode 100 to selectively characterize droplets. A droplet separation means 74 is used to separate droplets selected for printing from the other droplets based on this characterization. Droplet separation means 74 may include any suitable means that can separate the droplets based on the characterization scheme that is employed. Without limitation, droplet separation means 74 may include one or more electrostatic deflection plates operable for applying an electrostatic force to separate droplets within the stream of droplets 70 when the characterization scheme involves a selective charging of droplets. When the droplets are characterized by selectively forming them with different sizes or volumes, droplet separation means 74 may include a lateral gas deflection apparatus as taught by Jeanmaire et al. in U.S. Pat. No. 6,554,410. In U.S. Pat. No. 6,554,410, a continuous gas source is positioned at an angle with respect to a stream of droplets. The stream of droplets is composed of a plurality of droplet volumes. The gas source is operable to interact with the stream of droplets thereby separating droplets consisting of one droplet volume from droplets consisting of another droplet volume. As shown in FIG. 2, droplet separation means 74 is employed to deposit droplets comprising a first characteristic onto receiver surface 42 while other droplets comprising a second characteristic are deposited to gutter 40.

In the embodiments described herein, at least one apparatus and method are described for stimulating non-conductive donor fluid 62 in inkjet print-head 56. Additionally, at leas one apparatus and method are described for selectively characterizing droplets formed from non-conductive fluid jet 63. It will be understood that non-conductive donor fluid 62 is not limited thereby to an ink and may comprise any non-conductive fluid that can form a jet and selectively characterized droplets as described herein in the embodiments of the present invention. Typically, non-conductive donor fluid 62 will carry a colorant, ink, dye, or other image forming material. However, donor fluid 62 can also carry dielectric material, electrically insulating material, or other functional material.

Further, in the embodiment illustrated in FIG. 2, receiver surface 42 is shown as comprising a generally paper type receiver medium, however, the invention is not so limited and receiver surface 42 may comprise any number of shapes and forms and may be made of any type of material upon which a pattern of non-conductive donor fluid 62 may be imparted in a coherent manner. Accordingly, in the embodiment illustrated in FIG. 2, translation unit 58 has been shown as having a motor 76 and arrangement of rollers 78 that selectively positions a paper type receiver surface 42 relative to a stationary inkjet print-head 56. This too is done for convenience and it will be appreciated, that receiver surface 42 may comprise any type of receiver surface 42 and translation unit 58 will be adapted to position either one of the receiver surface 42 and inkjet print-head 56 relative to each other.

Figure 3:
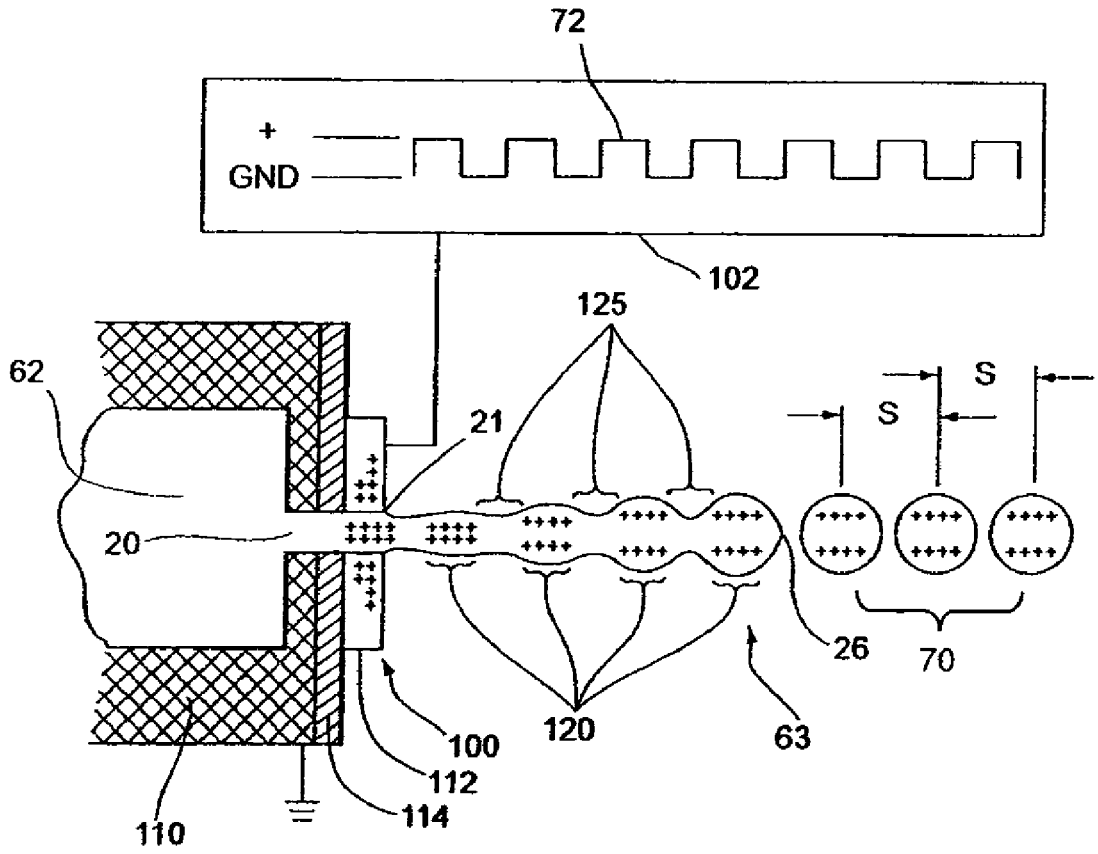
FIG. 3 is a schematic representation of an apparatus employing a droplet stimulation electrode.

FIG. 3 schematically shows droplet stimulation electrode 100 for stimulating a stream of droplets 70 from a non-conductive fluid jet 63. Fluid supply 64 contains non-conductive donor fluid 62 under pressure which forces non-conductive donor fluid 62 through nozzle channel 20 in the form of a jet. Droplet stimulation electrode 100 is preferably made from an electrically conductive material, and is preferably concentric with an exit orifice 21. Droplet stimulation electrode 100, along with droplet stimulation driver 102 are operable for electrohydrodynamically stimulating a jet of non-conductive fluid into a stream of droplets.

Droplet stimulation electrode 100 is configured such that it is in direct electrical communication with non-conductive donor fluid 62. Droplet stimulation electrode 100 is itself electrically conductive, or must include at least one electrically conductive electrical contact layer 112 that is in intimate contact with non-conductive donor fluid 62. Ideally, electrical contact layer should be produced from materials that have appropriate wear resistance and chemical resistance with respect to the composition of non-conductive donor fluid 62.

Droplet stimulation electrode 100 may be constructed by a variety of micromachining methods, and may be formed on, or from a substrate 110. Electrical contact layer 112 may be made from a surface metallization layer. The surface metallization layer is typically deposited on one or more insulating layers 114, especially when substrate 110 possesses conductive properties. Substrates 110 suitable for the embodiments of the present invention may include, but are not limited to materials such as glass, metals, polymers, ceramics and semiconductors doped to various conductivity levels.

Figure 4:
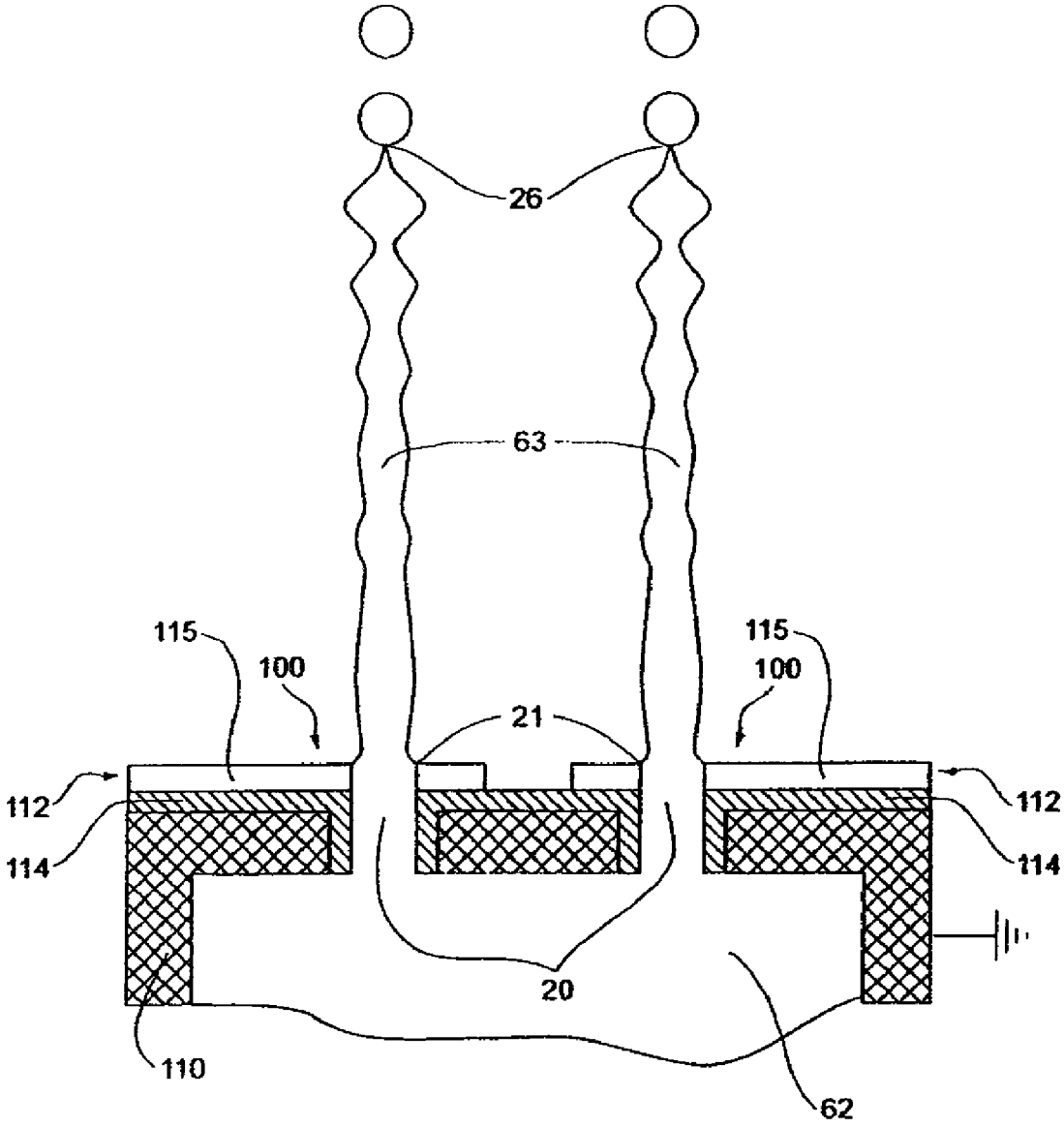
FIG. 4 is a cross-sectional view of a print-head incorporating a droplet stimulation electrode.

FIG. 4 shows a cross-sectional view of a substrate 110 that includes a plurality of droplet stimulation electrodes 100 that may be used in an embodiment of the present invention. Each of the droplet stimulation electrodes 100 includes an electrical contact layer 112 that surrounds the exit orifices 21 of the nozzle channels. As shown in FIG. 4, the electrical contact layers 112 are formed from a metal layer 115 that is formed on an insulating layer 114. Insulating layer 114 isolates the metal layer 115 from substrate 110, which in this embodiment of the invention is a conductive substrate. The nozzle channels 20 and their corresponding exit orifices 21 may be formed by etching, preferably by a reactive ion etch. Insulating layer 114, which is preferably made from silicon dioxide, may also be applied to the inner surfaces of nozzle channels 20 to add further electrical isolation between metal layer 115 and substrate 110. Optionally, metal layer 115 may also be applied over portions of insulating layer 114 that may cover the inner surfaces of nozzle channels 21. As shown in FIG. 3, nozzle channel 20 may be defined by corresponding openings in substrate 110, insulating layer 114 and electrical contact layer 112 which are formed into an integrated assembly. In this embodiment, electrical contact layer 112 defines exit orifice 21 from which jet 63 is emitted.

Figure 5:
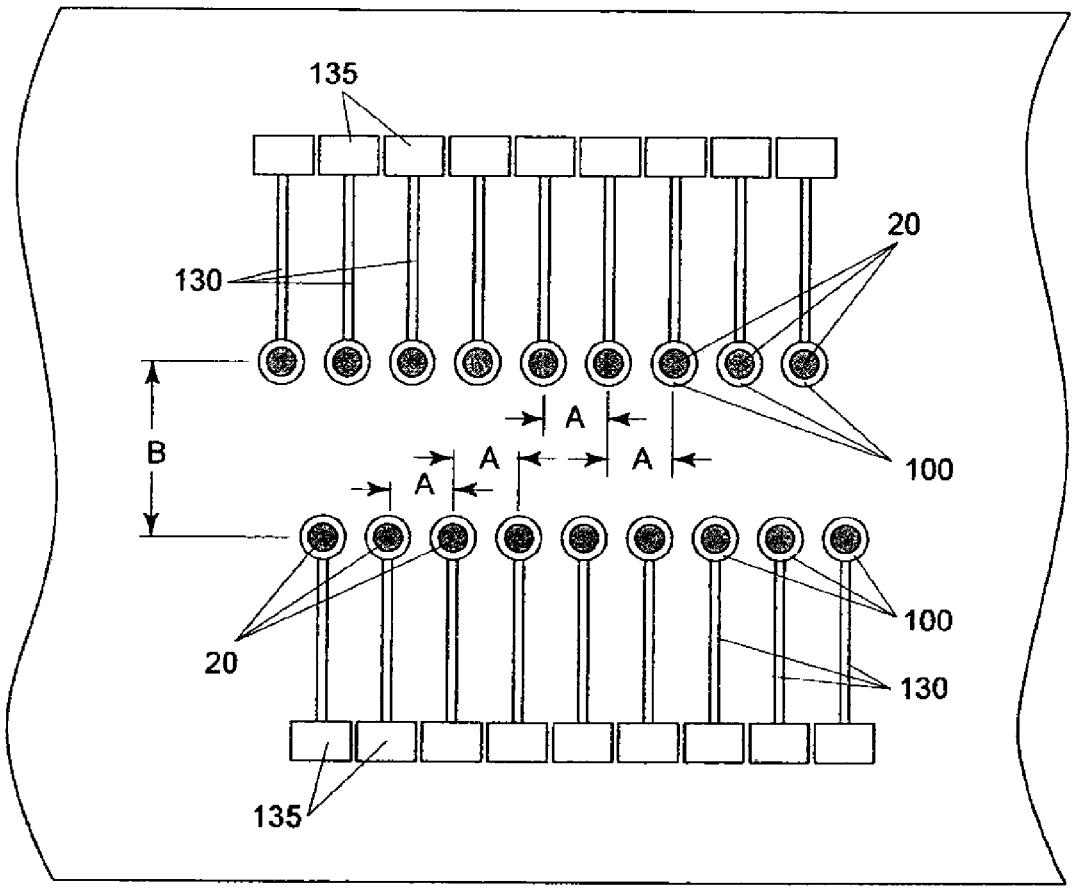
FIG. 5 is a plan view of a multi-jet nozzle and associated droplet stimulation electrodes.

As shown in FIG. 5, electrical contact layer 112 may be patterned around nozzle channels 20 to form various isolated electrical pathways 130 to each of the droplet stimulation electrodes 100 positioned at each of the nozzle orifices 20. Electrical contacts 135 may be made to each independent pathway. Electrical leads may be attached to the electrical pathways by a means such as wire bonding. A separate droplet stimulation driver 102 (like the one shown in FIG. 3, for example) may be connected to each electrical lead in order to independently drive each of the electrodes surrounding the nozzle bores. Alternatively, droplet stimulation drivers 102 may be incorporated into substrate 110.

In FIG. 5, two parallel rows of nozzles are arranged on a substrate. A fixed spacing, A separates nozzle channels 20 within each row from each other, and the rows themselves are separated from one another by a distance, B. In this arrangement, the nozzle channels 20 in each of the two rows both have the same center-to-center spacing A, but the rows themselves may be offset from one another by a portion of this spacing. This construction allows two rows of nozzles with greater spacing (i.e. a lower resolution) to form a system with combined smaller effective spacing (a higher resolution). The separation of both the rows by spacing B, and the nozzles within a given row by a spacing A will typically permit more room for electrical contacts 135 on the substrate surface and thereby reduced interaction between the electrically conductive pathways 130, as well as reduced electrostatic interactions between droplets generated by different nozzles channels 20. Other embodiments of the present invention may incorporate different arrangements of nozzles channels 20 and droplet stimulation electrodes 100.

Referring back to FIG. 4, when electrical contact layer 112 comprising a metal layer 115, one or more nozzles channels 20 may be first etched in substrate 110 prior to patterning a metal layer 115 around the nozzle channels 20. In yet another embodiment of the present invention, metal layer 115 may be first patterned onto substrate 110 such that the pattern is suitably registered with the intended location of the nozzle channels 20. Using the patterned metal layer as a mask, nozzles channels 110 may then be etched through substrate 110.

Although electrical contact layer 112 may include a metal layer, other materials that are sufficiently conductive and possess properties that are compatible with a desired non-conductive fluid to be jetted may be used. When state-of-the art MEMS fabrication techniques are employed, droplet stimulation electrode 100 may be made from suitable semiconductor substrates that provide the necessary properties including conductivity. Further, although the preferred droplet stimulation electrodes have been described as being produced by state of the art MEMS fabrication techniques, this is not to be considered to be a limitation. As such, additional example embodiments of the invention may include droplet stimulation electrodes produced from any appropriate materials using any appropriate fabrication techniques known in the art.

As shown in FIGS. 3, 4, and 5, openings in the electrical contact layer 112 are positioned and sized around each of the exit orifices 21 so that the electrical contact layer is in direct intimate contact with the non-conductive donor fluid 62 as it is jetted from the exit orifices 21. The position of electrical contact layer 112 is not limited to the embodiment shown these figures. Alternate embodiments of the present invention may include droplet stimulation electrodes which have an electrical contact layer 112 positioned on an inner surface of the nozzle channel 20 itself. Placement of droplet stimulation electrode 100 may vary so long as the electrical contact layer 112 intimately contacts the non-conductive donor fluid 62 such that a charge can be transferred to non-conductive donor fluid 62 in order to stimulate non-conductive fluid jet 63 to form stream droplets 70.

Under the influence of the droplet stimulation driver 102, droplet stimulation electrode 100 is typically driven to a potential that is relative to a ground point located at some point on the apparatus. One possible location of the ground point may be a portion of a conductive substrate that makes up the nozzle plate comprising the one or more nozzles channels 20 as shown in FIG. 3. The amount of charge transferred to the fluid jet 63 at a given stimulation potential will vary depending on the location of the ground and will be typically become smaller as the ground point is moved further away from the droplet stimulation electrode.

In the example embodiment of the present invention shown in FIG. 3, an electrohydrodynamic stimulation of non-conductive fluid jet 63 forms the stream of droplets 70. The forming of droplets may result from an outward radial pressure buildup that arises from the repulsion of "like" charges that are transferred to the surface of the jet 63 by droplet stimulation electrode 100. Although this example embodiment of the invention describes a build up of electrohydrodynamic pressures due to a transfer of charge to the jet of non-conductive fluid, these electrohydrodynamic pressures may be generated by several mechanisms. A primary mechanism may arise from a coulomb force that acts on a free charge in an electric field. Free charge is typically injected or directly transferred to the fluid from an electrode at high potential in contact with the fluid. Secondary mechanisms of generating electrohydrodynamic pressures in non-conductive fluids may involve charge polarization and the electrostriction effect. Although establishing a charge in the non-conductive fluid to induce EHD pressure effects will typically arise from the primary mechanism of direct charge transfer, it is to be understood that other EHD mechanisms may contribute to the establishment of these effects.

It is also be possible to stimulate a jet of non-conductive fluid to form a stream of droplets by transferring charges of opposite polarity to different regions located around the perimeter of the jet. In such a case, droplets may be formed by a pinching effect that is created by an attraction of the transferred opposite polarity charges. In these cases a droplet stimulation electrode may be spilt into a plurality of corresponding electrodes portions. Each portion of the droplet stimulation electrode may be driven by a separate droplet stimulation driver to charge each respective region of the jet with a charge comprising a desired polarity. Such a case may produce droplets that have a neutral net charge.

Figures 6, 6A:
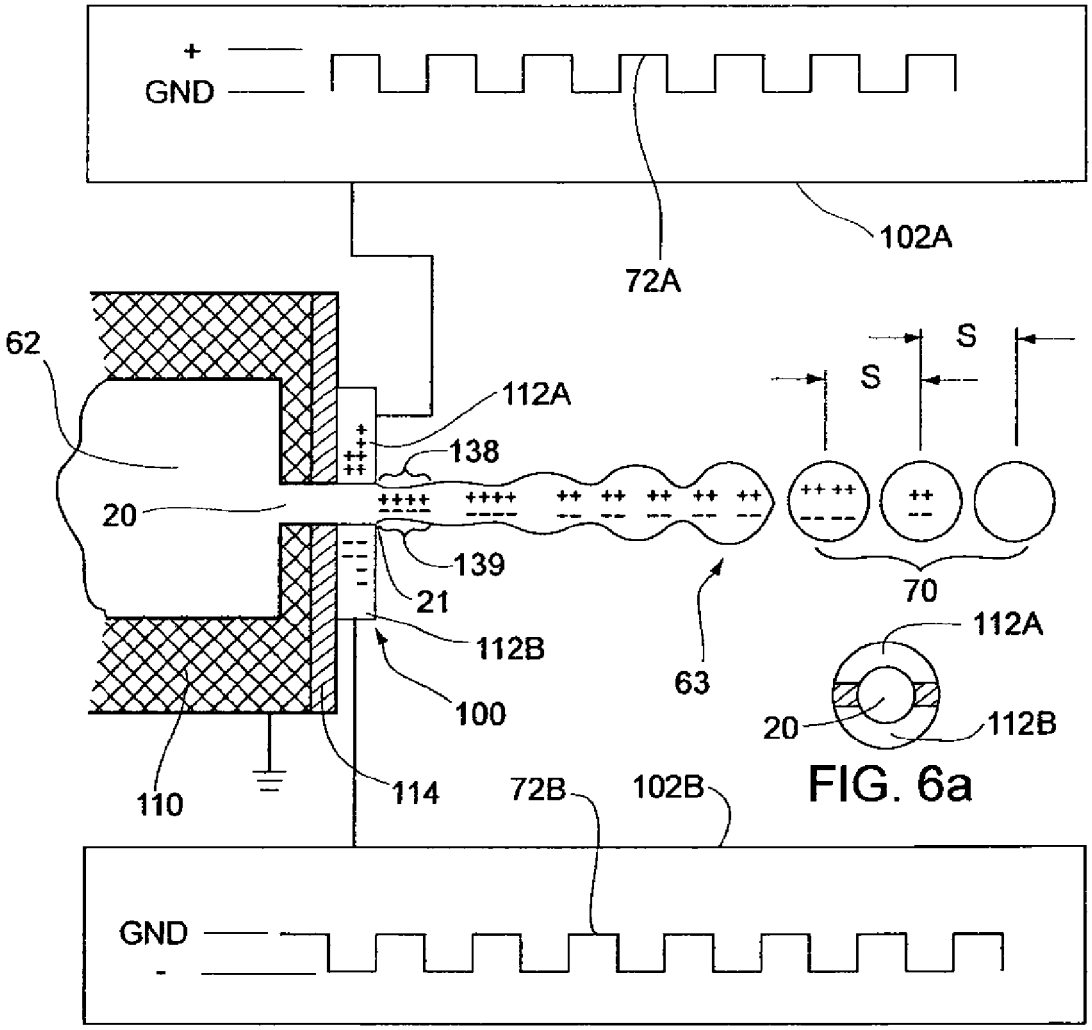
FIG. 6 is a schematic representation of an apparatus employing a droplet stimulation electrode that includes a plurality of electrical contact layers.
FIG. 6A is a cross-section view of the droplet stimulation electrode shown in FIG. 6.

FIGS. 6 and 6A show another example embodiment of droplet stimulation electrode 100 according to the present invention. Droplet stimulation electrode 100 includes a plurality of electrically conductive portions 112A and 112B. In this embodiment, droplet stimulation electrode 100 is divided into two electrical contact layer portions 112A and 112B, with each layer being arranged to be in intimate contact with opposing regions of non-conductive fluid jet 63. Separate droplet stimulation drivers 102A and 102B are electrically connected to the separate electrical contact layer portions 112A and 112B. Droplet stimulation drivers 102A and 102B are driven with by two droplet stimulation signals 72A and 72B. Each of the droplet stimulation signals can comprise, for example, uni-polar square signal waveforms with a 50% duty cycle. Although the two signal waveforms have substantially equivalent amplitudes and wavelengths, they differ from one another in that they have opposite polarity when compared to each other.

Under the influence of droplet stimulation signals 72A and 72B, corresponding potential waveforms are created in which positive charge is applied to a first region 138 of a portion of non-conductive fluid jet 63 while negative charge is applied to a second region 139 of a portion of non-conductive fluid jet 63. Preferably, the regions are located on opposing sides of each other. With equal and different polarities applied to the opposing regions of non-conductive fluid jet 63, the net charge on the jet segment comprising the two regions is substantially zero. However, an attraction between these opposite charges creates an electrohydrodynamic pinching effect on the non-conductive fluid jet 63 at these regions. Droplets subsequently form from at least the regions of the jet located between the dissimilarly charged regions. Further, since an equal distribution of positive and negative charges is transferred to droplets after break-off, the droplets 70 are substantially neutral in total charge. The formed droplets are substantially equally charged and substantially equally sized. Preferably, both droplet stimulation signals 72A and 72B are synchronized such that the opposing regions of unlike charge distribution are positioned to create the pinching effect.

It should be noted that the stimulation effect illustrated by the droplet stimulation electrode 100 embodiment shown in FIG. 3 can also be substantially recreated with the electrode embodiment shown in FIG. 6 by simply synchronously providing droplet stimulation signals with the same identical waveforms (polarity included) to each of the droplet stimulation drivers 102A and 102B.

Referring back to FIG. 3, droplet stimulation driver 102 generates a potential waveform (not shown) of chosen voltage amplitude, period and functional relationship with respect to time. This potential waveform will alternately charge various regions of non-conductive fluid jet 63. As herein described, a region of a non-conductive fluid jet may comprise any area of the jet that is intimately contacted by an electrical contact surface of a droplet stimulation electrode, regardless of whether charge is, or is not transferred to the region. As such, a region may comprise a complete surface area that extends around the perimeter of the jet, or a portion of the complete surface area. In accordance with the droplet generation characteristics that are desired, charged regions 120 represent various charged portions of non-conductive fluid jet 63 while uncharged regions 125 represent other uncharged portions of the jet. For a correctly chosen frequency of the potential waveform, a perturbation resulting from these charged and uncharged regions will grow on non-conductive fluid jet 63 until droplets break-off from the jet at a point further downstream.

The break-off of droplets from the non-conductive fluid jet 63 occurs at break-off point 26. For the sake of clarity, this droplet break-off is exaggerated in FIG. 3 and the start of break-off may take on the order of many droplet spacings; typically 20 S wherein "S" is a center-to-center separate distance between the formed droplets. During the electrohydrodynamic formation of droplets in prior art continuous inkjet printers, any local charge redistribution due to the stimulation quickly vanishes because a conductive fluid is used. In the present invention, charges that are transferred to the non-conductive fluid jet 63 as a consequence of the EHD stimulation of that jet are not quickly dissipated. As shown in FIG. 3, droplets will form as the non-conductive fluid jet 63 separates in the areas between the charged regions 120. A non-limiting example of droplet stimulation signal 72 includes a uni-polar square wave with a 50% duty cycle. As shown in FIG. 3, each of the resulting droplets will be of substantially equal size or volume and will be equally spaced from one another by an equal center-to-center distance, S, since the stimulation signal 72 waveform is uniform and cyclical in nature. The formed droplets will each have substantially the same charge since each of the charges transferred to charged regions 120 are subsequently isolated within each of the droplets that break off from a corresponding charged region 120. Droplet charge levels and uniformity of charging is controlled by the potential waveform that is applied to the droplet stimulation electrode 100 and any leakage of charge through fluid jet 63 prior to droplet break-off. Drop stimulation electrode 100 gives rise to a simultaneous stimulation and charging of droplets from a non-conductive fluid jet.

Embodiments of the present invention allow for a charge that induces droplet stimulation from a non-conductive fluid jet to be "locked-in" the subsequently formed droplets. This "locking-in" of charge may allow the formed droplets to be characterized for different purposes that may include be printed with, or not being printed with. In various embodiments of the present invention, characterization typically requires modifying the droplet stimulation signal 72 such that various portions of its signal waveform will not necessarily be identical during the formation of selected droplets formed from stimulated non-conductive fluid jet 63. Portions of the droplet stimulation signal 72 signal waveform may be varied in some form including, but not limited to, amplitude, periodicity, pulse width and polarity. Portions of the droplet stimulation signal 72 signal waveform may be varied to characterize selected droplets within the stream of droplets 70 with different charge levels, charge polarities or different sizes or volumes. These specific characterizations may be used to at least in part distinguish each of the droplets for different purposes including whether each of the specific droplets is to be printed or not printed. Such modification of droplet stimulation signal 72 may potentially vary the time to break-off of differently characterized droplets, but does not fundamentally affect the droplet stimulation mechanism as taught by embodiments of the present invention.

When droplet stimulation signal 72 is varied to characterize droplets created from the stimulation a non-conductive fluid jet, droplet stimulation signal 72 becomes a droplet characterization signal 140. Droplet characterization signal 140 is provided to a droplet stimulation driver 102 that in turn produces a potential waveform that is provided to a droplet stimulation electrode 100. Since this potential waveform is used to selectively characterize droplets formed from the non-conductive fluid jet 63, droplet stimulation driver 102 and droplet stimulation electrode 100 are respectively referred to as droplet characterization driver 145 and droplet characterization electrode 150. Without limitation, exemplary embodiments droplet characterization electrode 150 may include any embodiment of droplet stimulation electrode 100 previously referred to.

Figure 7:
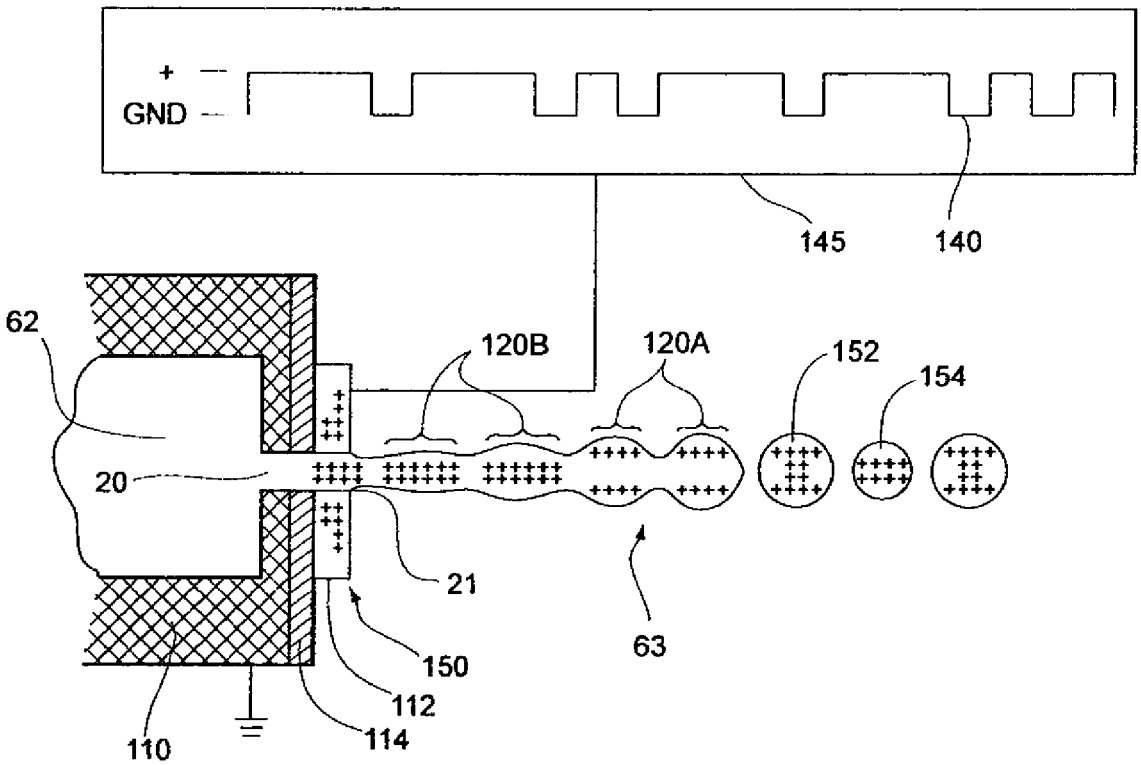
FIG. 7 is a schematic representation of an apparatus employing a droplet characterization electrode and droplet characterization signal, as per an example embodiment of the present invention.

Referring to FIG. 7, droplet characterization electrode 150 comprises at least one electrical contact layer 112 and is operable to selectively characterize a non-conductive fluid droplet by at least in part transferring a charge to a region of non-conductive fluid jet 63 from which the droplet is subsequently formed. The at least one electrical contact layer 112 is configured and positioned to contact the non-conductive fluid jet 63. The at least one electrical contact layer 112 is capable of transferring a charge to at least one region of fluid jet 63. The droplet may be selectively characterized by at least a portion of the charge transferred to a region of a portion of the jet from which the droplet was formed. The droplet is characterized for different purposes that may include printing or, not printing the droplet.

As shown in FIG. 7, an example embodiment of the present invention includes a droplet characterization signal 140 that comprises an exemplary signal waveform that may be used to create droplets with different volumes. Droplet characterization signal 140 is provided to droplet characterization driver 145. droplet characterization signal 140 includes a waveform with varying periodicity and pulse width. Each pulse in droplet characterization signal 140 is selectively chosen to have a specific pulse width, which in this embodiment comprise one of two pulse widths. The spacing between successive pulses, regardless of whether the successive pulses have the same pulse width is maintained at a constant level that leads to the varying periodicity of the waveform. Droplet characterization electrode 150 creates a corresponding potential waveform with differing pulse width and periodicity attributes.

In this example embodiment of the present invention, droplet characterization signal 140 alternates between two different positive pulse durations. The time in which charges are transferred to each region of the non-conductive fluid jet will thus differ in accordance with these varying pulse durations. By example, since non-conductive fluid jet 63 is traveling with a constant velocity, charged region 120A will differ in length from that charged region 120B that is longer since charge was transferred to region 120B for a longer time. The transfer of charges to these regions of non-conductive fluid jet 63 will cause a stream of droplets to form at break-off point 26. The distance between successively formed droplets will typically vary in accordance with the changing periodicity of droplet characterization signal 140. As exemplified by large droplet 152 and small droplet 154, the formed droplets will be of different sizes, since the volume of each droplet depends on the pulse duration of the characterization pulse that created it. In this embodiment of the invention, a given droplet's volume will typically be dependant on the varying periodicity of the signal waveform.

There is typically an operating region wherein the charge-to-mass ratio (q/m) of the formed droplets is relatively constant. The pulse duration of the potential waveform determines the length of a region of the non-conductive jet onto which charge is transferred. The volume or mass of a droplet that forms from this region of the jet is thus proportional to the length of that region. The magnitude of the transferred charge will be proportional to the duty cycle and the amplitude of a particular potential waveform pulse used to transfer charge to a region of the non-conductive fluid jet. In the embodiment of the present invention shown in FIG. 7 wherein the pulse width of the droplet characterization signal 140 waveform is varied, non-conductive droplets of varying sizes will be formed but each of the droplets will have a substantially equal q/m ratio. It will typically not be possible to characterize and separate these droplets by employing conventional electrostatic means.

Despite the fact that such droplets have selectively varying charges, their masses also vary in direct proportion to the level of these charges. Conventional electrostatic deflection means employ an electric field of magnitude, E to apply a force of magnitude, F on a particle bearing charge, q. The magnitude of the force, F may be determined by the relationship: $F=q E$. The degree of deflection in the electrostatic field that a particle of mass, m undergoes is proportional to the particle's acceleration, a. Acceleration, a may be determined according to relationship $a=F/m$, or alternatively, $a=(q/m) E$. This relationship indicates that any acceleration of the particle in the presence of a given deflection field is identical for equivalent charge-to-mass ratios, and particles so characterized cannot be separated by some conventional electrostatic methods.

Referring back to FIG. 7, it should be noted that each of the formed droplets can be characterized by the fact that they are composed of one of a plurality of droplet sizes or droplet volumes. It is to be noted that in this context, droplet size or volume may also refer to mass when the droplets are formed from homogenous non-conductive fluids. These size-characterized droplets can at least be selected to be printed with, or to not be printed with, based on their size. These size-characterized droplets can thus be separated by known methods in the art including a lateral gas deflection method.

In this embodiment of the present invention, selective characterizing involves creating a droplet characterization signal 140 that has a waveform made up of selective pulses of varying pulse widths. A first set of pulses will comprise a first pulse width, and may initiate the transfer of charges to create printing droplets. A second set of pulses comprising a second pulse width may initiate the transfer of charges to create non-printing droplets. Accordingly, the waveform may vary in accordance with a print data stream.

Figure 8:
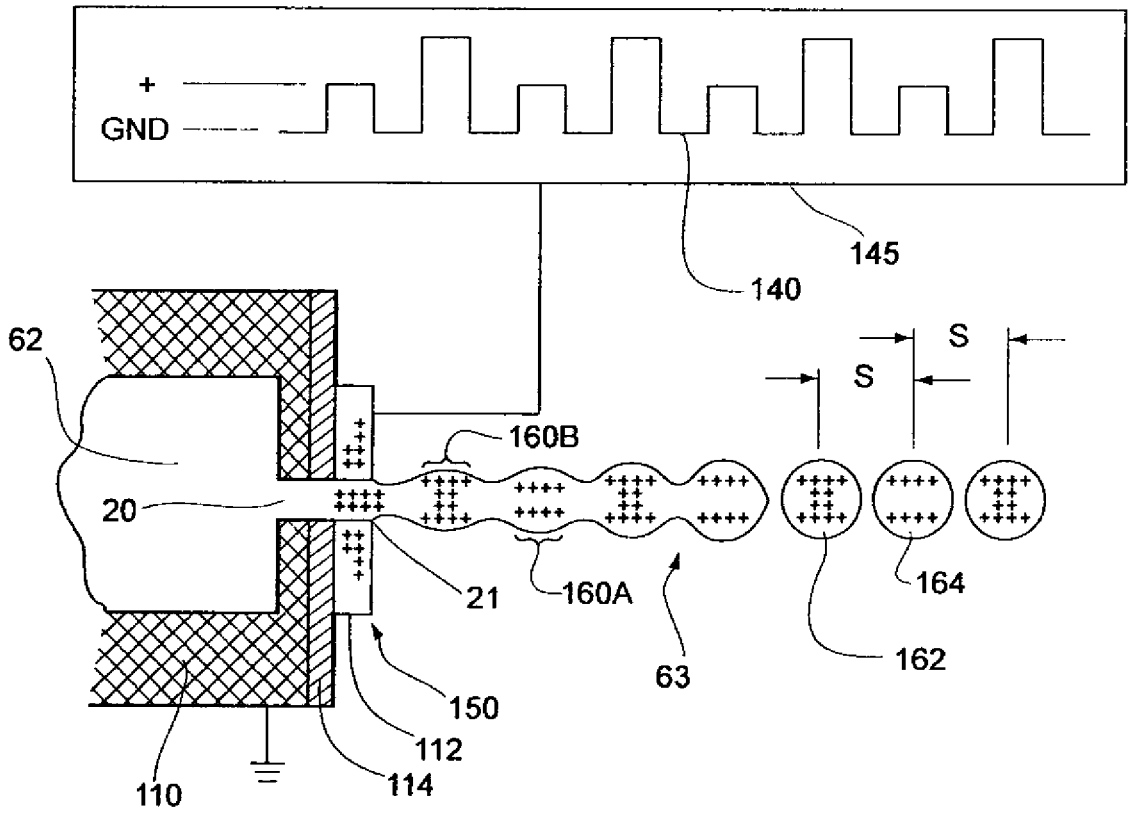
FIG. 8 is a schematic representation of the droplet characterization electrode shown in FIG. 7 and another droplet characterization signal, as per another example embodiment of the present invention.

FIG. 8 shows another example embodiment of the present invention. In this embodiment, the signal waveform of droplet characterization signal 140 is made up of pulses of varying amplitude but with a constant pulse width and periodicity. In this example embodiment of the invention, droplet characterization signal 140 alternates between two different positive pulse levels. Under the influence of droplet characterization signal 140, droplet characterization driver 145 will create a corresponding potential waveform. In accordance with the potential waveform, charges are selectively transferred to various regions of the non-conductive fluid jet 63 during the time that each of the regions is in intimate contact with the electrical contact layer 112.

In this example embodiment of the invention, the length of each of the charged regions will be substantially the same but the magnitude of the charge transferred to each of the regions may vary. By way of example, the amount of charge transferred to charged region 160A differs from the amount of charge transferred to charged region 160B. Even though charged region 160B has substantially the same length as region 160A, region 160B has more transferred charge. When droplet break-off subsequently occurs, droplets 162 ands 164 will be of substantially similar size since a constant pulse width was employed, but each of these droplets will carry different charge magnitudes. Additionally, each successively formed droplet will be separated by a constant spacing, S. Therefore, this example embodiment of the present invention produces droplets with different q/m ratios that can be combined with prior art electrostatic deflection plates to alter the trajectory of the each of the differently charged droplets. Although the charges transferred to the droplets are of the same polarity, they vary in magnitude, and the trajectory of each of the differently charged droplets can be altered in proportion to the specific level of charge on each of the respective droplets. Hence droplets characterized to be printed droplets can be further segregated from droplets characterized not to be printed droplets.

In this example embodiment of the present invention, the waveform of droplet characterization signal 140 may vary in amplitude in accordance with a print data stream. The waveform may, or may not vary in accordance with a given guard drop scheme. The use of guard drop schemes may help to reduce undesired droplet-to-droplet electrostatic field effects. The amplitude of each pulse of droplet characterization signal 140 would thus vary in accordance with whether the droplet that is subsequently formed from this information is to be printed or not. In this example embodiment of the invention, droplet characterization signal 140 comprises information that will result in the stimulation and characterization of non-conductive droplets.

It should be further noted that the droplets characterized to be printed droplets may be further characterized to strike plurality of different positions on the recording surface if desired. This may be accomplished by further varying the amplitude of selected pulses of droplet characterization signal 140 such that charge-to-mass ratio of corresponding charged droplets is varied in accordance to a desired position on the recording surface to which the respective droplets are to be deflected onto.

Figure 9:
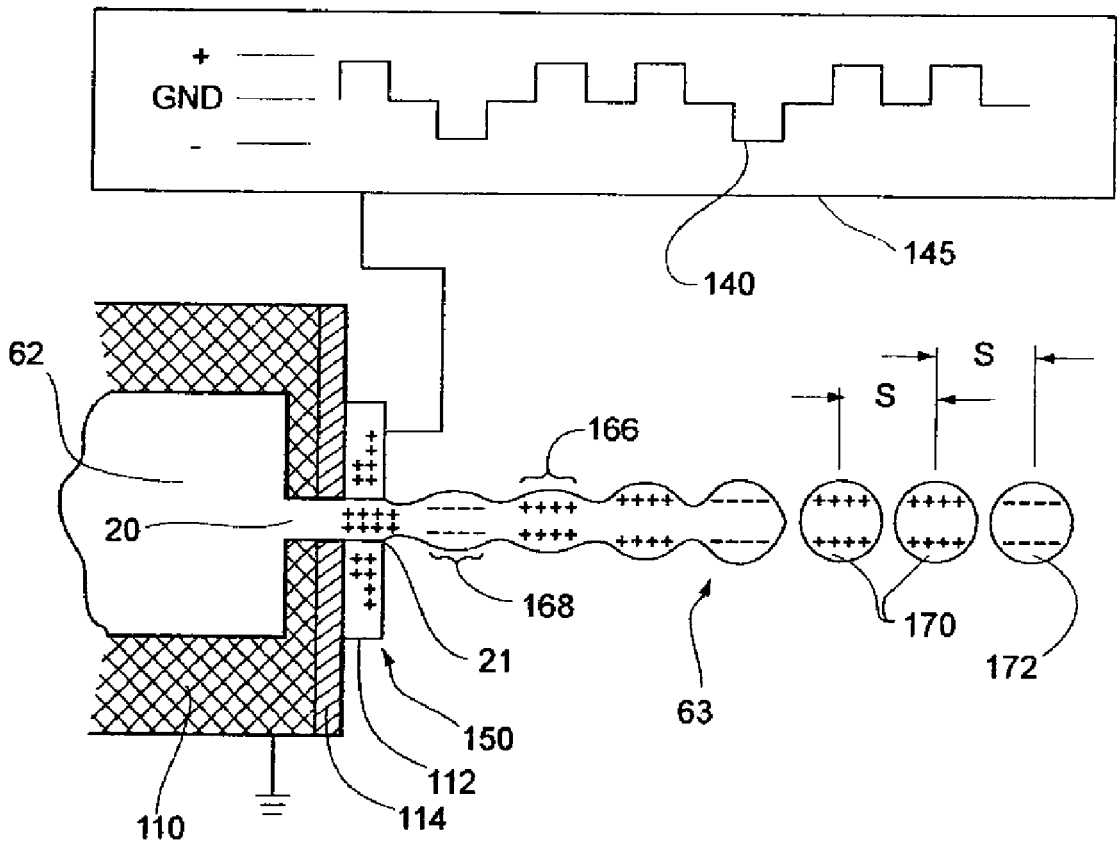
FIG. 9 is a schematic representation of the droplet characterization electrode shown in FIG. 7 and yet another droplet characterization signal, as per another example embodiment of the present invention.

Another example embodiment of the present invention is shown in FIG. 9. In this example embodiment of the invention, opposite charges are applied to the droplets in accordance to the bipolar waveform of the droplet characterization signal 140. Droplet characterization electrode 150 is electrically connected to droplet characterization driver 145. Droplet characterization signal 140 is used to vary a potential waveform generated by droplet characterization driver 145 in a data-dependant manner. Although the pulses of the droplet characterization signal 145 have differing polarities, they each have substantially uniform amplitudes, pulse widths and periodicity. Equally spaced droplets of substantially equal volume subsequently form. However, these equally sized droplets are selectively charged with charges of opposite polarity.

Under the influence of droplet characterization signal 140, droplet characterization driver 145 will create a corresponding potential waveform. In accordance with the potential waveform, charges are selectively transferred to various regions of the non-conductive fluid jet 63 during the time that each of the regions is in intimate contact with the electrical contact layer 112. Each charged region of the non-conductive jet 63 is thus either a region 166 to which positive charge is transferred, or a region 168 to which negative charge is transferred. The resulting EHD pressure in each region of like charges gives rise to a pressure perturbation that will induce droplets to subsequently break-off from the jet. Upon droplet break-off, each droplet will substantially comprise the charge that was transferred to the corresponding region of the portion of non-conductive fluid jet 63 from which each droplet was formed. By example, droplets 170 are charged positively, whereas droplets 172 are charged negatively. The formed droplets each have a substantially equal charge to mass (q/m) ratio but are characterized by being charged by one of two polarities. Such droplets may be separated for by conventional electrostatic deflection means. By example, negatively charged droplets 172 may be deflected by deflection electrodes (not shown) along a first trajectory, whereas positively charged droplets 170 are deflected by deflection electrodes (not shown) along a second trajectory. The first trajectory may be chosen to gutter the droplets that have been characterized not to print while the second trajectory may directed characterized print droplets towards a recording surface (not shown). The waveform of the droplet characterization signal 140 may correspond to a print data sequence of an image to be recorded In this example embodiment of the invention, droplet characterization signal 140 comprises information that will result in the stimulation and characterization of non-conductive fluid droplets.

Figure 10:
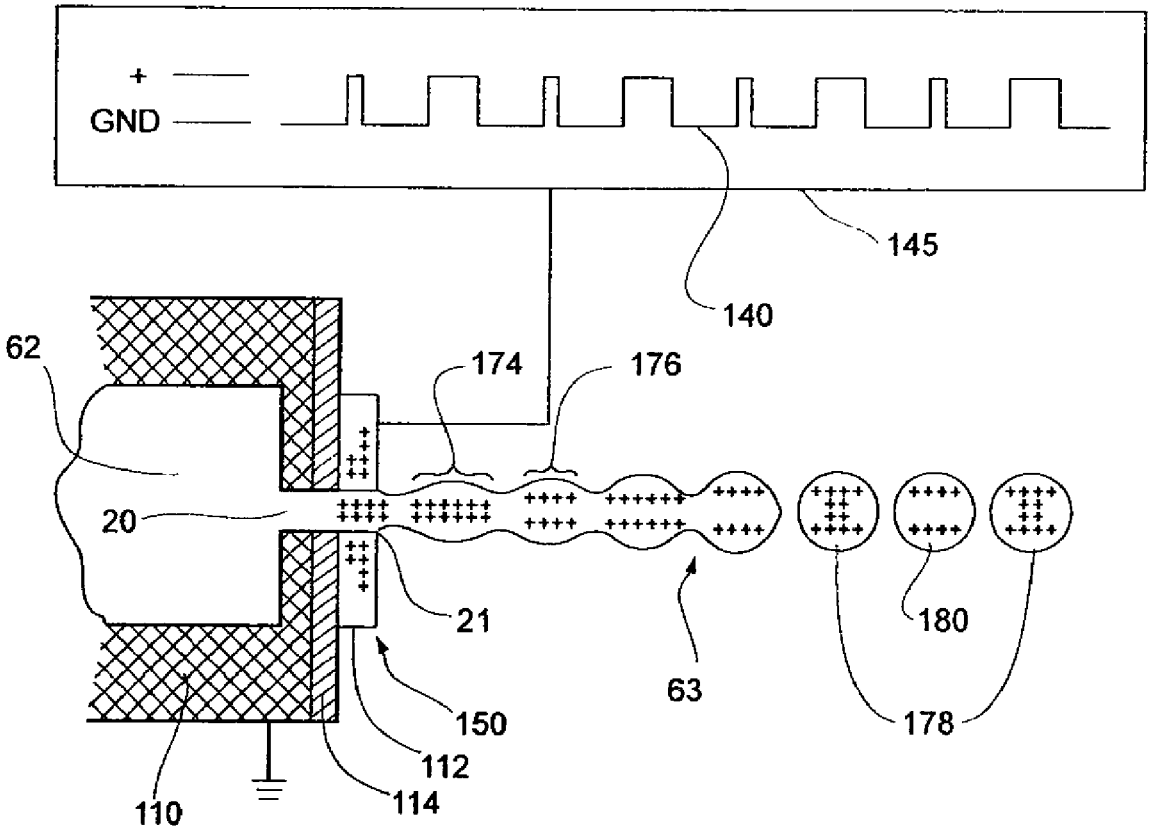
FIG. 10 is a schematic representation of the droplet characterization electrode shown in FIG. 7 and another droplet characterization signal, as per another example embodiment of the present invention.

FIG. 10 shows yet another example embodiment of the present invention. In this example embodiment, the waveform of droplet characterization signal 140 is made up of pulses of varying pulse widths and non-varying amplitudes. A constant periodicity is additionally maintained. In this example embodiment of the invention, droplet characterization signal 140 includes a signal waveform with two different pulse widths. Under the influence of droplet characterization signal 140, droplet characterization driver 145 will create a corresponding potential waveform. In accordance with the potential waveform, charges are selectively transferred to various regions of the non-conductive fluid jet 63 during the time that each of the regions is in intimate contact with the electrical contact layer 112. The magnitude of the charge transferred to each of the regions may vary in accordance with a corresponding pulse width. By way of example, the amount of charge transferred to region 174 differs from the amount of charge transferred to region 176 in accordance with the time required to transfer each amount of charge. Formed droplets 178 and 180 will each carry different charge magnitudes. Although the pulses have varying pulse widths, the signal waveform has a constant periodicity. The droplets will therefore be typically formed at a substantially constant rate and may have substantially the same volume. Each of the droplets will be selectively characterized by a distinct charge-to mass ratio. Such characterized droplets may be separated by any of the appropriate means disclosed in the other example embodiments of the present invention. It should be note that although successively formed droplets will typically be produced with a constant droplet-to-droplet spacing, this may not always persist downstream if the varying pulse widths of droplet characterization signal 140 lead to variations in the time-to-break-off for each droplet. Variations in the time-to-break-off may have an effect on velocity and volume uniformity.

Figure 11:
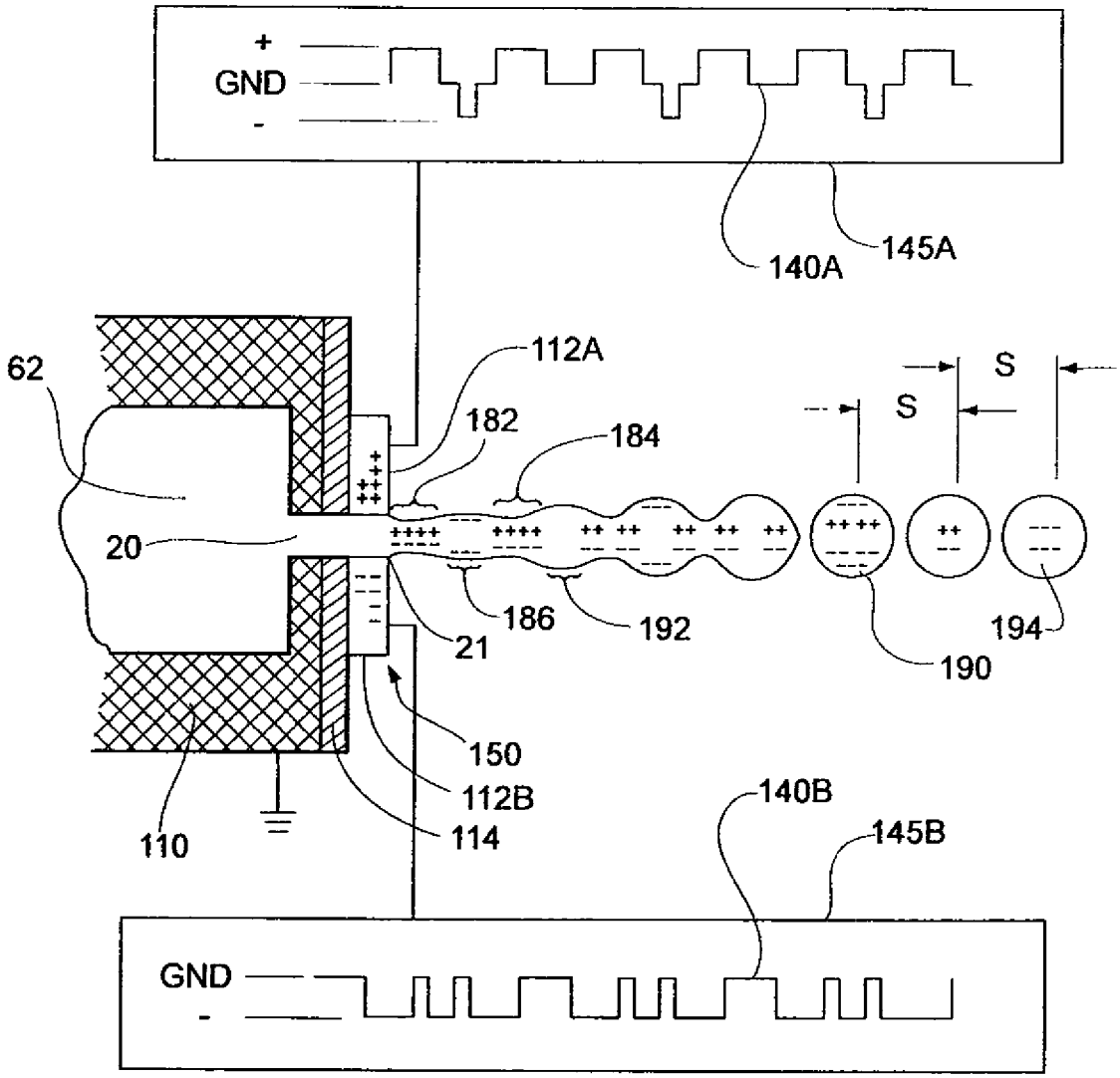
FIG. 11 is a schematic representation of an apparatus employing a droplet characterization electrode that includes a plurality of electrical conductive portions, as per another example embodiment of the present invention.

In another example embodiment of the present invention shown in FIG. 11, neutrally, negatively and positively charged droplets are formed. Droplet characterization electrode 150 includes a plurality of electrode portions including two electrical contact layer portions 112A and 112B, with each of the two layers being arranged to be in intimate contact with opposing regions of non-conductive fluid jet 63. In accordance with droplet characterization signals 140A and 140B, droplet characterization drivers 145A and 145B each apply a potential waveforms to a respective one of electrical contact layer portions 112A and 112B. Droplet formation may be initiated between the oppositely charged regions 182 and 184 of non-conductive fluid jet 63 where opposing charges of opposite polarity have been transferred. Additionally, charges of a given polarity may be transferred by both droplet characterization drivers 145A and 145B to a region 186 located between the regions 182 and 184. By way of non-limiting example, charges transferred to regions 186 are shown to have a negative polarity. It is understood that positive charges or multitude of different polarity charges that result in some net charge may also be just as readily transferred to region 186.

It should be noted that a transferred net charge may result in a substantially neutral polarity as represented by neutral droplet 190. Neutral droplets may also be formed from region 192, which have had no additional charges transferred to. In such cases, these neutral droplets would only be subject to a transfer of a balanced charge created only by the opposing charges that are transferred to promote droplet formation as exemplified in regions 182 and 184. It is to be further noted that a transfer of balanced and opposing charges to form a given droplet, does not typically affect any additional charge or charges transferred to give the given droplet some overall positive, negative or neutral polarity. This may be demonstrated by negatively charged droplet 194 whose overall negative polarity arose from a transfer of negative charge to a corresponding region from which droplet 194 was characterized. Such a region is exemplified by region 186. Thus, the formed droplets are primarily characterized by charge that is, or is not transferred to corresponding regions that are pinched off during the formation of the droplets.

During the characterization of a given droplet that is formed by the example embodiment of the invention shown in FIG. 11, the segregation between the opposing charges that are transferred to promote droplet formation and the additional charges that are transferred to impart a specific positive, negative or neutral charge characterization on a particular droplet is possible because of the non-conductive properties of the jetted non-conductive donor fluid 62. Waveform adjustment provided by droplet characterization drivers 145A and 145B may be required to produce both neutral and charged droplets of substantially the same volume since like charges transferred to region 186 will typically tend to pinch off more quickly. To maintain the same droplet volume among neutral and charged droplets, the duty cycle of certain pulses of the potential waveforms associated with the transfer of opposing charges required to induce droplet formation may be varied for the negatively and positively charged droplets, or alternatively, the neutral charged droplets. Hence, in this example embodiment of the present invention, a non-conductive fluid jet can be stimulated to produce droplets of substantially the same volume with each of the droplets being characterized by surface charges that can be neutral, positive or negative.

Additionally, the charged droplets can be further characterized by having a different volume than the neutral droplets. In either case, such droplets are suitable for use in a multi-row nozzle array (not shown) in which electrostatic deflection electrodes are used to deflect positively charged droplets to a first gutter means, negatively charged droplets to a second gutter means, and neutrally charged droplets are used to print on a recording surface.

It is readily apparent to those skilled in the art that various characterization schemes which for example are illustrated by the droplet characterization electrode 100 embodiment shown in FIGS. 7 through 10 may also be substantially recreated with the electrode and electrical driver embodiment shown in FIG. 11 by simply providing two appropriately configured droplet characterization signals 140A and 140B whose waveforms are adjusted in accordance with a desired characterization scheme.

Non-conductive fluids suitable for droplet stimulation according to embodiments of the present invention may be defined by a range of resistivities whose numerical values may be determined by parameters including, but not limited to, the time to droplet break-off, the fluid jet diameter, and the center-to-center distance S between the formed droplets. According to the embodiments of the invention described herein, droplet stimulation of a non-conductive fluid jet is made possible since once charges are transferred to the various regions of the jet, the charges have exceptionally limited capability to dissipate or to migrate along the length of the jet. Preferably, transferred charges should not be able to discharge or migrate more than the center-to-center distance S of the subsequently formed droplets. A time required for a discharge or migration of the transferred charges preferably should be greater than the cumulative time required to transfer a charge to a charged region 120 of the fluid jet 62 and then incorporate that charged region 120 into a corresponding droplet at break-off point 26.

Estimates of the non-conductive fluid resistivity range required for droplet stimulation and characterization may be determined by requiring that a discharge time constant, $T_{RC}$ of the transferred charges be of the same duration, or longer than a droplet time-to-break-off interval, $T_b$. Therefore, $T_{RC} \geqq T_b$. Time-to-break-off interval, $T_b$ may be measured from the time charge is transferred from electrical contact layer 112 to a given charged region to the time a specific droplet is formed at break-off point 26 from that given region. Time-to break-off interval $T_b$ will typically vary as a function of the electrohydrodynamic stimulation strength, the diameter of non-conductive fluid jet 63, and the non-conductive fluid properties themselves.

Estimates of the discharge time constant, $T_{RC}$, may be made by modeling a non-conductive fluid jet as a fluid column in free space surrounded by a grounded cylindrical surface. A capacitance per unit length, $C_L$ of the fluid column may be estimated by the relationship:

$$C_L = 2\pi\in/|\ln(r_j/r_g)|, \text{ where:}$$

$r_j$ is a radius of the non-conductive fluid jet, $r_g$ is a radial distance from the jet to the surrounding grounding surface, and $\in$ is the permittivity of a medium surrounding the non-conductive fluid jet.

When the non-conductive fluid jet is surrounded by air, the value of $\in$ in the above relationship differs only marginally from the permittivity in free space or vacuum denoted as $\in_0$. Accordingly, $\in = \in_{air} = 1.0006\,\in_0$ (at atmospheric pressure, 20 degrees Celsius). Other types surrounding mediums may alter the effective permittivity such that $\in = \in_{eff} * \in_0$, wherein $\in_{eff} > 1$. For the purpose of making an estimate of capacitance per unit length, $\in = \in_0$ may be used to calculate a lower limit of capacitance. As previously stated, various ground points may be located on an apparatus defined by the present invention. Although these ground points may be located proximate to non-conductive fluid jet 63, modeling the reference ground as a distantly positioned surrounding grounded cylindrical surface may be used to provide a lower limit for the capacitance per unit length and hence, a lower limit for the discharge time constant $T_{RC}$.

For embodiments of the invention in which charge dissipation over a maximum jet length of one droplet-to-droplet spacing, S is acceptable, the total capacitance C for a length of the non-conductive fluid jet equal to droplet-to-droplet spacing S may be estimated by the relationship: $C = C_L \cdot S$.

The resistance R of a length S of the non-conductive fluid jet may be estimated by the relationship:

$$R = \rho_f S/(\pi \cdot r_j^2), \text{ where}$$

variables S and $r_j$ are as previously defined, and variable $\rho_f$ is the resistivity of the non-conductive fluid.

The discharge time constant is given by the relationship: $T_{RC} = RC$. Accordingly, a minimum resistivity, $\rho_f$ of a non-conductive fluid required for droplet stimulation and characterization as described by embodiments of the present invention may be estimated by the following relationship:

$$\rho_f \geqq |T_b(\tfrac{1}{2}\in)(r_j^2/S^2)\ln(r_j/r_g)|, \text{ where:}$$

variables $T_b$, $\in$, $r_j$, $r_g$ and S are as previously defined with $\in$ being substantially equal to $\in_0$ when an air atmosphere is present.

As an example, for a jet radius $r_j$=5 um, a grounding radius $r_g$=1 m, a droplet center-to-center distance, S=50 um, and a time to break-off, $T_b$=0.1 msec, a required non-conductive fluid resistivity, $\rho_f$ would be in excess of ~70 MΩ-cm. This value is on the order of the resistivity of ultra pure water (approximately 18 MΩ-cm). This exemplified estimated level of resistivity may be considered to be an approximate lower limit, which may or may not preclude using numerous aqueous inks in embodiments of the present invention. However, inks made with low viscosity high resistivity fluids have resistivity levels that are typically many orders of magnitude above the estimated minimum. An example of such a fluid is isoparaffin with a resistivity of $2 \cdot 10^{13}$ Ω-cm. It is to be noted that the above exemplified estimated resistivity level is very conservative since it was based on a model that specified a non-conductive fluid jet-to-ground distance of 1 meter. In practical applications of embodiments of the present invention, non-conductive fluid jet-to-ground distances are likely to be much closer thereby allowing for a lower non-conductive fluid resistivity limit. Practical lower limits for the resistivity of a non-conductive fluid employed in embodiments of the present invention may be as low as 1 MΩ-cm depending on the grounding configuration used.

Embodiments of the present invention have described means and methods of transferring charge to a non-conductive fluid jet to form a stream of droplets. This transfer of charge may also include a transfer of charge to characterize a droplet with a certain charge polarity. The transfer of charge may also include the transfer of charge to stimulate the jet to selectively form droplets of a desired shape, size or volume characteristic. The charge transferred to a non-conductive fluid jet is typically locked-in, unlike a charge that is applied to a conductive fluid jet. For a given level of charging, the arising electrohydrodynamic stimulation as described in various embodiments of the present invention, is typically stronger than that of prior art techniques involving an electrohydrodynamic stimulation of conductive fluids.

The strength of the droplet forming stimulation is typically proportional to the internal radial pressure created by the electrohydrodynamic effect on charged regions of non-conductive fluid jet 63. A radial pressure, P due to a charge transferred to a region of jet 63 may be estimated by the following relationship:

$$P = 1/(2\in)\cdot\sigma^2, \text{ where}$$

variable $\in$ is as previously defined and is substantially equal to $\in_0$ when an air atmosphere is present, and $\sigma$ is a charge density, which in turn may be derived by the relationship:

$$\sigma = q/(2\pi r_j \cdot S), \text{ where}$$

variable q is a resulting droplet charge, and variables $r_j$ and S are as previously defined.

By example, for a resulting droplet charge on the order of q=100 fC, a droplet center-to-center distance, S=50 um, and a jet radius, $r_j$=5 um, the radial pressure P on the jet may be estimated to be approximately 230 Pa. This radial pressure value is similar to induced pressures created by prior art EHD droplet stimulation electrodes employed to stimulate conductive fluid jets. However, the stimulation of non-conductive fluid jets as per embodiments of the present invention typically acts on a jet for a greater duration of time than would occur with a similar stimulation of a conductive fluid jet. This extended duration is due to the relative immobility of transferred charge on the non-conductive fluid jet. Therefore, the non-conductive EHD stimulation provided by embodiments of the present invention may be considered to be stronger than that of prior art conductive fluid EHD stimulators.

A corresponding upper limit of a potential, V required for the transfer of charge during droplet stimulation and characterization of the various embodiments of the present invention may be estimated by the following relationship:

$V=q/C$, where variables q and C are as previously defined.

The potential V may be estimated to be 430 volts for the previously example in which q=100 fC, S=50 um, $r_j$=5 um, and wherein $r_g$ is additionally taken to equal 1 m. The capacitance value C used to obtain this estimate was based upon the derived capacitance per unit length of the non-conductive fluid jet located in free space inside a large diameter grounded cylindrical surface. Accordingly, this capacitance value may be considered to be a lower limit, and consequently an upper limit for the potential estimated by the above relationship. In actual practice, the capacitance of non-conductive fluid jet 63 with respect to the droplet stimulation electrode 100 is a function of the geometry of the electrode shape, and the position of the electrode 100 near the non-conductive fluid jet 63. The actual capacitance value is typically higher than that of the above estimated capacitance value. Hence, a suitable potential may be much lower than estimated above, especially with an appropriate choice of electrode geometry and with an added placement of a nearby ground electrode to further increase the capacitance.

As described in various embodiments of the present invention, the droplet stimulation electrode 100 is to be considered to be a droplet characterization electrode 150, if an input signal to an associated driver comprises both droplet stimulation and droplet characterization information. Accordingly, the droplet characterization electrodes 150 may be operable for stimulating and characterizing droplets on the basis of one or more charges that are transferred to various regions of a non-conductive fluid jet. In these embodiments of the invention, the droplet stimulating means is substantially identical to the droplet characterizing means.

If so desired, alternative embodiments of the present invention may only employ the charge-based droplet characterizing aspects that have been disclosed. In this case, droplet stimulation of the non-conductive fluid jet would need to be accomplished by other means. Such other means could include, but are not limited to mechanical stimulation, piezoelectric stimulation and thermal stimulation. Needless to say, these embodiments of the invention may be more costly and more difficult to implement since the stimulation means chosen would need to be synchronized with the characterization means of the present invention. Further, the stimulation strength of these alternate stimulation means may be greater to override additional droplet stimulation effects that may be created by droplet characterization electrode 150. Alternatively, the stimulation effects created by droplet characterization electrode 150 may be added to those created by these other stimulation means.

Various illustrated embodiments of the present invention have been described with reference to a single nozzle channel. Other example embodiments of the present invention may also include a group or row of multiple nozzles. Other example embodiments of the present invention may also include multi-jet or multi-rows of nozzles. Various apparatus incorporating embodiments of the preset invention may include without limitation, continuous inkjet and multi-jet continuous inkjet apparatus.

The invention has been described in detail with particular reference to certain example embodiments thereof, but it will be understood that variations and modifications can be effected within the scope of the invention.

PARTS LIST

10 fluid supply
12 conductive fluid
13 prior art conductive electrode structure
15 prior art droplet stimulation electrode
17 prior art stimulation signal driver
19 stimulation signal
20 nozzle channel
21 exit orifice
22 prior art conductive fluid jet
24 insulating layers
26 break-off point
30 charge electrode
32 charge electrode driver
34 charged droplets
36 uncharged droplets
38 electrostatic deflection plates
40 gutter
42 receiver surface
50 printing apparatus
52 housing
54 interior chamber
56 print-head
58 translation unit
60 system controller
62 non-conductive donor fluid
63 non-conductive fluid jet
64 source of pressurized non-conductive donor fluid
65 first direction
66 droplet generation circuit
70 stream of droplets
72 droplet stimulation signal
72A droplet stimulation signal
72B droplet stimulation signal
74 droplet separation means
76 motor
78 rollers
100 droplet stimulation electrode
102 droplet stimulation driver
102A droplet stimulation driver
102A droplet stimulation driver
110 substrate
112 electrically conductive electrical contact layer
112A electrical contact layer portion
112B electrical contact layer portion
114 insulating layer
115 metal layer
120 charged regions
120A charged region
120A charged region
125 uncharged regions
130 conductive pathways
135 electrical contacts
137 conductive ground ring
140 droplet characterization signal
140A droplet characterization signal
140B droplet characterization signal
145 droplet characterization driver
145A droplet characterization driver
145 droplet characterization driver
150 droplet characterization electrode

152 large droplet
154 small droplet
160A charged region
160B charged region
162 droplet
164 droplet
166 region
168 region
170 positively charged droplet
172 negatively charged droplet
174 region
176 region
178 droplet
180 droplets
182 oppositely charged region
184 oppositely charged region
186 region
190 neutral droplets
192 region
194 negatively charged droplet

The invention claimed is:

1. A method of characterizing fluid droplets comprising:

providing a non-conductive fluid jet;

providing a first electrical charge on an electrically conductive portion of a characterization electrode;

characterizing a first fluid droplet formed from a first portion of the non-conductive fluid jet by causing the electrically conductive portion of the characterization electrode to be initially in intimate contact with the first portion of the non-conductive fluid jet to transfer the first electrical charge from the electrically conductive portion of the characterization electrode to a region of the first portion of the non-conductive fluid jet that stimulates the non-conductive fluid jet to form a first fluid droplet;

providing a second electrical charge on the electrically conductive portion of the characterization electrode; and characterizing a second fluid droplet formed from a second portion of the non-conductive fluid jet by causing the electrically conductive portion of the characterization electrode to be in intimate contact with the second portion of the non-conductive fluid jet after the electrically conductive portion of the characterization electrode has been in intimate contact with the first portion of the non-conductive fluid jet, the electrically conductive portion of the characterization electrode being in intimate contact with the second portion of the non-conductive fluid jet to transfer a second electrical charge to a region of the second portion of the non-conductive fluid jet that stimulates the non-conductive fluid jet to form a second fluid droplet, wherein the first fluid droplet formed from the first portion of the non-conductive fluid jet has a first characteristic determined by the first electrical charge transferred to the region of the first portion and the second fluid droplet formed from the second portion of the non-conductive fluid jet has a second characteristic that is different than the first characteristic and is determined by the second electrical charge transferred to the region of the second portion.

2. The method of claim 1, wherein providing the first electrical charge on the electrically conductive portion of the characterization electrode and providing the second electrical charge on the electrically conductive portion of the characterization electrode includes providing a droplet characterization signal to the characterization electrode.

3. The method of claim 2, wherein the droplet characterization signal comprises a signal waveform including a first amplitude and a second amplitude, the first amplitude being associated with the first electrical charge and the second amplitude being associated with the second electrical charge.

4. The method of claim 2, wherein the droplet characterization signal comprises a signal waveform including a first polarity and a second polarity, the first polarity being associated with the first electrical charge and the second polarity being associated with the second electrical charge.

5. The method of claim 2, wherein the droplet characterization signal comprises a signal waveform including a first pulse width and a second pulse width, the first pulse width being associated with the first electrical charge and the second pulse width being associated with the second electrical charge.

6. The method of claim 5, wherein the signal waveform includes a constant periodicity.

7. The method of claim 5, wherein the signal waveform includes a varying periodicity.

8. The method of claim 1, the first electrical charge comprising a plurality of first electrical charges, and the second electrical charge comprising a plurality of second electrical charges, wherein transferring the first electrical charge from the electrically conductive portion of the characterization electrode to the first portion of the non-conductive fluid jet includes transferring one of the plurality of first electrical charges to a first region of the first portion of the non-conductive fluid jet and another of the plurality of first electrical charges to a second region of the first portion of the non-conductive fluid jet, and transferring the second electrical charge from the electrically conductive portion of the characterization electrode to the second portion of the non-conductive fluid jet includes transferring one of the plurality of second electrical charges to a first region of the second portion of the non-conductive fluid jet and another of the plurality of second electrical charges to a second region of the second portion of the non-conductive fluid jet.

9. The method of claim 8, wherein the first and second regions are opposing regions.

10. The method of claim 1, wherein the non-conductive fluid jet comprises a non-conductive fluid having a resistivity, $\rho_f$, chosen to satisfy the following relationship:

$$\rho_f \geqq |T_b(\tfrac{1}{2}\in)(r_j^2/S^2)\ln(r_j/r_g)|, \text{ wherein:}$$

$T_b$ is a break-off time for each fluid droplet, $\in$ is a permittivity of a medium surrounding the non-conductive fluid jet, $r_j$ is a radius of the non-conductive fluid jet, $r_g$ is a distance from the non-conductive fluid jet to a ground surface, and S is a center-to-center distance between successively formed fluid droplets.

11. The method of claim 1, wherein the non-conductive fluid jet comprises a non-conductive fluid having a resistivity $\geqq 1$ MΩ-cm.

12. A method of characterizing fluid droplets comprising:

providing a non-conductive fluid jet;

providing a first electrical charge on an electrically conductive portion of a characterization electrode;

characterizing a first fluid droplet formed from a first portion of the non-conductive fluid jet by transferring the first electrical charge from the electrically conductive portion of the characterization electrode to the first portion of the non-conductive fluid jet;

providing a second electrical charge on the electrically conductive portion of the characterization electrode; and characterizing a second fluid droplet formed from a second portion of the non-conductive fluid jet by transferring the second electrical charge from the electrically conductive portion of the characterization electrode to the second portion of the non-conductive fluid jet, wherein the non-conductive fluid jet comprises a non-conductive fluid having a resistivity, $\rho_f$, chosen to satisfy the following relationship:

$$\rho_f \geqq |T_b(\tfrac{1}{2}\in)(r_j^2/S^2)\ln(r_j/r_g)|, \text{ wherein:}$$

$T_b$ is a break-off time for each fluid droplet, $\in$ is a permittivity of a medium surrounding the non-conductive fluid jet, $r_j$ is a radius of the non-conductive fluid jet, $r_g$ is a distance from the non-conductive fluid jet to a ground surface, and S is a center-to-center distance between successively formed fluid droplets.

* * * * *